US011241097B2

(12) United States Patent
Cieszko et al.

(10) Patent No.: US 11,241,097 B2
(45) Date of Patent: Feb. 8, 2022

(54) PORTABLE CHAIR

(71) Applicant: YETI Coolers, LLC, Austin, TX (US)

(72) Inventors: Michael Christopher Cieszko, Austin, TX (US); Evan Goldberg, Austin, TX (US); Andrew J. Winterhalter, Austin, TX (US)

(73) Assignee: YETI Coolers, LLC, Austin, TX (US)

( * ) Notice: Subject to any disclaimer, the term of this patent is extended or adjusted under 35 U.S.C. 154(b) by 0 days.

(21) Appl. No.: 16/891,215

(22) Filed: Jun. 3, 2020

(65) Prior Publication Data

US 2020/0383481 A1 Dec. 10, 2020

Related U.S. Application Data

(60) Provisional application No. 62/857,001, filed on Jun. 4, 2019.

(51) Int. Cl.

| | |
|---|---|
| ***A47C 5/10*** | (2006.01) |
| ***A47C 4/42*** | (2006.01) |
| ***A47C 4/28*** | (2006.01) |
| ***A47C 4/46*** | (2006.01) |
| *A47C 7/28* | (2006.01) |

(52) U.S. Cl.

CPC ..... *A47C 4/42* (2013.01); *A47C 4/28* (2013.01); *A47C 4/46* (2013.01); *A47C 5/10* (2013.01); *A47C 7/282* (2013.01)

(58) Field of Classification Search

CPC .... A47C 4/42; A47C 5/10; A47C 4/10; A47C 4/30; A47C 4/44; A47C 4/06; A47C 1/0265; A47C 4/20; A47C 4/34; A47C 4/28; A47C 4/46; A47C 7/282

See application file for complete search history.

(56) References Cited

U.S. PATENT DOCUMENTS

| | | | |
|---|---|---|---|
| 1,268,631 A | 6/1918 | Schaeffer | |
| 1,856,429 A | 5/1932 | Rodriguez | |

(Continued)

FOREIGN PATENT DOCUMENTS

| | | | | |
|---|---|---|---|---|
| BE | 905470 A * | 1/1987 | ..... | A47C 1/0265 |
| CA | 182409 A | 7/2019 | | |

(Continued)

OTHER PUBLICATIONS

PDF of machine translation of CN 208837396-U. (Year: 2019).*

(Continued)

*Primary Examiner* — Robert Canfield

(74) *Attorney, Agent, or Firm* — Banner & Witcoff, Ltd.

(57) ABSTRACT

A portable chair may include a first front leg and a second front leg connected by a front sled and a first back leg and a second back leg connected by a back sled. The first front leg and the first back leg may be pivotally connected to a sliding pivot on an armrest, where the sliding pivot moves relative to the armrest to adjust the chair from an upright position to a reclined position. The seat assembly may include a fabric member that is attached secured to a seat frame by a plurality of fabric retention members. In some examples, the portable chair may include a fabric member is releasably connected to the seat frame and back frame and also extends from a forward rail of the seat frame to a top rail of the back frame.

19 Claims, 21 Drawing Sheets

(56) References Cited

U.S. PATENT DOCUMENTS 1,985,823 A * 12/1934 Freedman ..... A47C 4/30 297/21
2,091,660 A 8/1937 Boogaard
2,213,590 A * 9/1940 Parry ..... A47C 1/0265 297/28
2,243,502 A * 5/1941 Freedman ..... A47C 4/40 297/28
2,474,597 A * 6/1949 Shwarzowsky ..... A47C 4/30 297/440.11
2,582,579 A * 1/1952 Bedford, Jr. ..... A47C 4/30 24/308
2,638,149 A * 5/1953 Janosek ..... A47C 4/02 297/411.42
2,638,970 A * 5/1953 Harber ..... A47C 4/48 297/39
2,652,098 A 9/1953 Nordmark
2,659,416 A * 11/1953 Heyman ..... A47C 1/0265 297/28
2,766,814 A * 10/1956 Sedlacek ..... A47C 7/22 160/371
2,920,686 A 1/1960 Thomas
2,981,316 A * 4/1961 Goebel ..... A47C 1/0265 297/359
3,075,811 A * 1/1963 Brown ..... A47C 1/143 297/359
3,084,739 A * 4/1963 Jaworski ..... A47C 31/04 160/402
3,084,979 A * 4/1963 Moore ..... A47C 4/06 297/451.9
3,094,358 A * 6/1963 Hartman ..... A47C 4/36 297/452.64
3,135,551 A * 6/1964 Andreoli ..... A47C 4/16 297/359
3,367,392 A 2/1968 Green
3,752,209 A * 8/1973 Swanson ..... A47C 31/04 160/327
4,014,591 A 3/1977 Gittings
4,065,173 A 12/1977 Gittings
4,105,244 A 8/1978 Colby
D263,525 S 3/1982 Colby
D275,533 S 9/1984 Lantz
4,470,630 A 9/1984 Shields
4,541,666 A * 9/1985 Vanderminden ..... A47C 1/14 297/16.1
4,652,048 A 3/1987 Nazar
4,674,793 A * 6/1987 Kettler ..... A47C 4/16 297/28
4,725,094 A 2/1988 Greer
4,826,241 A 5/1989 Barras
4,898,421 A * 2/1990 Brunn ..... A47C 1/0265 297/28
5,058,950 A 10/1991 Mann
5,139,308 A 8/1992 Ziman
5,318,342 A 6/1994 Hale
5,318,348 A 6/1994 Hess
5,358,263 A 10/1994 Aldus et al.
5,527,088 A * 6/1996 MacLean ..... A45F 4/02 224/155
5,570,928 A 11/1996 Staunton et al.
5,588,696 A 12/1996 Jay et al.
5,662,383 A 9/1997 Hand
5,762,403 A 6/1998 Robinson
5,779,314 A 7/1998 Grace
5,855,409 A 1/1999 Tseng
5,897,161 A 4/1999 Karg
5,911,478 A 6/1999 Goodman
5,927,812 A 7/1999 Vanderminden, Sr.
D417,561 S * 12/1999 Liu ..... D6/368
6,062,639 A 5/2000 Hill
6,062,648 A 5/2000 Adler
6,082,813 A 7/2000 Chen
6,170,907 B1 1/2001 Tsai
D438,394 S 3/2001 Tseng
6,206,462 B1 3/2001 Huang
6,247,749 B1 6/2001 Yu
6,302,479 B1 10/2001 Zheng
6,322,138 B1 11/2001 Tang
6,364,409 B1 4/2002 Saul et al.
6,382,715 B1 5/2002 Tang
6,419,311 B1 7/2002 Tang
6,439,656 B1 8/2002 Liu
6,454,348 B1 9/2002 Wu
6,523,894 B1 2/2003 Mellace
6,554,364 B1 4/2003 Dammermann et al.
6,560,827 B1 5/2003 Gross
6,585,323 B2 7/2003 Gaylord et al.
6,595,582 B1 7/2003 Liu
6,601,912 B1 8/2003 Chen
6,604,789 B1 8/2003 Downing
6,607,240 B2 8/2003 Zheng
6,629,722 B1 10/2003 Tang
6,634,705 B1 10/2003 Zheng
6,637,811 B2 10/2003 Zheng
6,644,731 B2 11/2003 Tang
6,676,206 B2 1/2004 Brandschain
6,698,827 B2 3/2004 Le Gette et al.
6,702,371 B2 3/2004 Zheng
6,736,450 B2 5/2004 Miyagi
6,739,652 B2 * 5/2004 Welsh ..... A47C 1/0265 297/129
6,752,414 B1 6/2004 Waldron et al.
6,764,132 B1 7/2004 Gaertner
6,779,849 B1 8/2004 Harper et al.
6,802,566 B2 10/2004 Prince et al.
6,814,403 B2 11/2004 Zheng
6,814,408 B2 11/2004 Chen
6,817,661 B2 11/2004 Zheng
6,817,671 B1 11/2004 Zheng
6,824,208 B2 11/2004 Zheng
6,824,210 B2 11/2004 Zheng
6,827,396 B1 * 12/2004 Jewell ..... A47C 7/002 297/16.1
6,840,574 B1 1/2005 Wu
6,899,383 B2 5/2005 Hwang
D507,424 S 7/2005 Rogasis
6,926,356 B2 8/2005 Chen
7,017,985 B2 3/2006 Chen
7,073,852 B1 7/2006 Zheng
7,080,877 B1 7/2006 Tsai
7,108,330 B2 9/2006 Mizelle et al.
7,178,863 B1 * 2/2007 Norval ..... A47C 4/20 297/29
7,185,948 B2 3/2007 Liu
7,201,450 B1 4/2007 Chen
7,234,779 B2 6/2007 Bedford et al.
D555,371 S 11/2007 Le Gal
7,325,875 B1 2/2008 Guerrini
7,334,837 B1 2/2008 Long
D565,868 S 4/2008 Matheus et al.
7,396,073 B2 7/2008 Zheng
7,404,601 B2 7/2008 Chen
7,475,889 B2 1/2009 Marmah et al.
7,481,495 B2 1/2009 Wang
7,533,939 B2 5/2009 Fookes et al.
7,556,317 B2 7/2009 Bottemiller
7,648,207 B2 1/2010 Lai
7,669,922 B2 3/2010 Murphy et al.
7,717,503 B1 5/2010 Watson
7,758,111 B2 7/2010 Chen
7,784,861 B1 8/2010 Deng
7,845,720 B2 12/2010 Randall
7,896,440 B2 3/2011 Tsai
7,942,476 B2 5/2011 Chen
7,950,734 B2 5/2011 Zheng
8,016,360 B2 9/2011 Machael et al.
D648,962 S 11/2011 Brodbeck
D651,010 S 12/2011 Cohen
8,100,469 B2 1/2012 Lougee
8,132,861 B2 3/2012 Cone
8,197,000 B1 6/2012 Cohen
8,251,442 B2 8/2012 Grace
8,303,032 B1 11/2012 Platta

(56) References Cited

U.S. PATENT DOCUMENTS

| | | | | |
|---|---|---|---|---|
| 8,317,270 | B2 | 11/2012 | Tseng | |
| 8,333,428 | B2 | 12/2012 | Zhu et al. | |
| 8,419,134 | B1 | 4/2013 | Yuan | |
| 8,523,283 | B2 | 9/2013 | Lee | |
| 8,550,565 | B2 | 10/2013 | Caldwell | |
| 8,585,135 | B2 | 11/2013 | Wilson | |
| 8,622,477 | B2 | 1/2014 | Colasanti et al. | |
| D699,492 | S | 2/2014 | Day | |
| 8,690,236 | B2 | 4/2014 | Gorinas et al. | |
| D706,050 | S | 6/2014 | Yang | |
| 8,794,703 | B2 | 8/2014 | Bateman et al. | |
| 8,820,825 | B2 | 9/2014 | Yang | |
| 8,864,221 | B1 | 10/2014 | Delvilla | |
| 8,864,222 | B2 | 10/2014 | Grace | |
| 8,864,223 | B2 | 10/2014 | Larson et al. | |
| 8,894,139 | B1 | 11/2014 | Coffey | |
| 8,899,673 | B2 | 12/2014 | Holland | |
| 8,919,884 | B2 | 12/2014 | Lee | |
| 8,967,724 | B2 | 3/2015 | Battey et al. | |
| D725,928 | S | 4/2015 | Battista | |
| 9,004,603 | B1 | 4/2015 | Wang | |
| 9,089,220 | B2 | 7/2015 | Weng | |
| 9,101,219 | B2 | 8/2015 | Smith | |
| 9,173,495 | B2 * | 11/2015 | Goldszer | A47C 4/18 |
| 9,204,729 | B2 | 12/2015 | Frankel et al. | |
| 9,247,818 | B2 | 2/2016 | Shively | |
| D752,890 | S | 4/2016 | Akkad | |
| 9,370,246 | B2 | 6/2016 | Baoqing et al. | |
| D762,394 | S | 8/2016 | Hardesty | |
| 9,451,829 | B2 | 9/2016 | Chen | |
| 9,538,840 | B2 | 1/2017 | Yang | |
| 9,585,481 | B2 | 3/2017 | Choi | |
| 9,596,938 | B2 | 3/2017 | Le et al. | |
| 9,700,139 | B2 | 7/2017 | Su | |
| D804,232 | S | 12/2017 | Oliphant et al. | |
| D804,880 | S | 12/2017 | Oliphant et al. | |
| D806,423 | S | 1/2018 | Silva et al. | |
| 9,867,466 | B2 | 1/2018 | Lovley, II | |
| 9,877,587 | B2 | 1/2018 | Grace | |
| 9,901,175 | B2 | 2/2018 | Chen | |
| D817,014 | S | 5/2018 | Zhu | |
| D823,612 | S | 7/2018 | Gumpel | |
| 10,051,954 | B2 | 8/2018 | Grace | |
| 10,070,729 | B2 | 9/2018 | Frankel et al. | |
| 10,070,730 | B2 | 9/2018 | Frankel et al. | |
| 10,070,731 | B2 | 9/2018 | Frankel et al. | |
| 10,098,467 | B2 | 10/2018 | Bayiokos | |
| 10,194,749 | B1 * | 2/2019 | Doolan | A47C 5/10 |
| 10,206,510 | B2 | 2/2019 | Choi | |
| 10,213,023 | B2 | 2/2019 | Yang | |
| D843,150 | S | 3/2019 | Doolan et al. | |
| D843,151 | S | 3/2019 | Doolan et al. | |
| D843,152 | S | 3/2019 | Doolan et al. | |
| D844,338 | S | 4/2019 | Franks et al. | |
| D848,756 | S | 5/2019 | Ren | |
| D849,437 | S | 5/2019 | Yang | |
| 10,278,506 | B2 | 5/2019 | Yang | |
| D850,135 | S | 6/2019 | Yang | |
| D850,810 | S | 6/2019 | Doolan et al. | |
| 10,357,098 | B2 | 7/2019 | Grace | |
| D855,343 | S | 8/2019 | Haingaertner | |
| 10,405,662 | B2 | 9/2019 | Cohen | |
| 10,455,941 | B2 | 10/2019 | Zhu et al. | |
| 10,463,157 | B1 | 11/2019 | Liniado | |
| 10,499,743 | B2 | 12/2019 | Frankel et al. | |
| 10,531,742 | B2 | 1/2020 | Reed | |
| 10,561,249 | B2 * | 2/2020 | Doolan | A47C 4/20 |
| 10,588,413 | B2 | 3/2020 | Mason et al. | |
| 10,602,845 | B2 | 3/2020 | Mason et al. | |
| 10,631,648 | B1 | 4/2020 | Tsai | |
| 10,631,651 | B1 | 4/2020 | Hsu Besner et al. | |
| 10,660,443 | B1 | 5/2020 | Tsai | |
| 10,681,992 | B2 | 6/2020 | Wang | |
| 10,709,250 | B2 | 7/2020 | Smith et al. | |
| 10,722,034 | B2 | 7/2020 | Winterhalter et al. | |
| 10,750,871 | B1 | 8/2020 | Smith | |
| 10,765,213 | B2 | 9/2020 | Pernet et al. | |
| D902,617 | S | 11/2020 | Sullivan et al. | |
| D911,730 | S | 3/2021 | Doolan et al. | |
| D911,731 | S | 3/2021 | Sullivan et al. | |
| D911,733 | S | 3/2021 | Sullivan et al. | |
| D912,423 | S | 3/2021 | Sullivan et al. | |
| 2002/0135210 | A1 * | 9/2002 | Tseng | A47C 7/54 297/28 |
| 2003/0020304 | A1 | 1/2003 | Zheng | |
| 2003/0025361 | A1 | 2/2003 | Liu | |
| 2004/0232740 | A1 | 11/2004 | Enge | |
| 2005/0194829 | A1 | 9/2005 | Aerts | |
| 2005/0236873 | A1 | 10/2005 | Edward | |
| 2007/0210628 | A1 | 9/2007 | Arnold | |
| 2009/0309394 | A1 | 12/2009 | Chen | |
| 2010/0013274 | A1 | 1/2010 | Chen | |
| 2010/0314914 | A1 | 12/2010 | Mazzola et al. | |
| 2011/0181078 | A1 | 7/2011 | Kelly et al. | |
| 2012/0175917 | A1 | 7/2012 | Chen | |
| 2013/0026799 | A1 * | 1/2013 | Miller | A47C 7/008 297/19 |
| 2014/0097647 | A1 | 4/2014 | Grace | |
| 2014/0339859 | A1 | 11/2014 | Holland et al. | |
| 2015/0061348 | A1 * | 3/2015 | Shen | A47C 7/56 297/463.1 |
| 2015/0084381 | A1 | 3/2015 | Nelson | |
| 2016/0051054 | A1 | 2/2016 | Choi | |
| 2016/0100688 | A1 | 4/2016 | Grace | |
| 2017/0000261 | A1 | 1/2017 | Block et al. | |
| 2017/0055711 | A1 | 3/2017 | Goldszer | |
| 2017/0105892 | A1 | 4/2017 | Epstein | |
| 2018/0078042 | A1 | 3/2018 | Lentz | |
| 2018/0084917 | A1 | 3/2018 | Weirun | |
| 2018/0255933 | A1 * | 9/2018 | Bayiokos | A47C 1/143 |
| 2019/0082846 | A1 | 3/2019 | Grace | |
| 2019/0350364 | A1 | 11/2019 | Tang | |
| 2020/0288870 | A1 | 9/2020 | Tsai | |
| 2020/0383481 | A1 | 12/2020 | Cieszko et al. | |

FOREIGN PATENT DOCUMENTS

| | | | | |
|---|---|---|---|---|
| CA | 182410 | A | 7/2019 | |
| CA | 3088264 | A1 | 7/2019 | |
| CH | 243560 | A * | 7/1946 | A47C 1/0265 |
| CN | 2200351 | Y | 6/1995 | |
| CN | 2561282 | Y | 7/2003 | |
| CN | 2561284 | Y | 7/2003 | |
| CN | 2617252 | Y | 5/2004 | |
| CN | 1500425 | A | 6/2004 | |
| CN | 3463184 | | 7/2005 | |
| CN | 3463190 | | 7/2005 | |
| CN | 3555786 | | 8/2006 | |
| CN | 2887149 | Y | 4/2007 | |
| CN | 300723583 | | 12/2007 | |
| CN | 300731416 | | 1/2008 | |
| CN | 300814505 | | 8/2008 | |
| CN | 300930648 | | 5/2009 | |
| CN | 300945526 | | 6/2009 | |
| CN | 301132539 | | 2/2010 | |
| CN | 301324411 | | 8/2010 | |
| CN | 301377966 | | 11/2010 | |
| CN | 301488297 | S | 3/2011 | |
| CN | 102151025 | A | 8/2011 | |
| CN | 202035773 | U | 11/2011 | |
| CN | 301724838 | | 11/2011 | |
| CN | 301724841 | | 11/2011 | |
| CN | 301724856 | | 11/2011 | |
| CN | 301765817 | | 11/2011 | |
| CN | 301782003 | | 1/2012 | |
| CN | 301836489 | | 2/2012 | |
| CN | 302015946 | | 8/2012 | |
| CN | 302050323 | S | 8/2012 | |
| CN | 302059696 | | 9/2012 | |
| CN | 302089011 | S | 9/2012 | |
| CN | 302197305 | | 11/2012 | |
| CN | 202604161 | U | 12/2012 | |
| CN | 302263537 | | 1/2013 | |
| CN | 302286012 | | 1/2013 | |

(56) References Cited

FOREIGN PATENT DOCUMENTS

| | | | | | |
|---|---|---|---|---|---|
| CN | 302294834 | S | | 1/2013 | |
| CN | 302337389 | | | 3/2013 | |
| CN | 302388829 | S | | 4/2013 | |
| CN | 302399200 | S | | 4/2013 | |
| CN | 202959547 | U | | 6/2013 | |
| CN | 202959550 | U | | 6/2013 | |
| CN | 302616768 | | | 10/2013 | |
| CN | 203290522 | U | | 11/2013 | |
| CN | 302684929 | | | 12/2013 | |
| CN | 203416980 | U | | 2/2014 | |
| CN | 203493167 | U | | 3/2014 | |
| CN | 203662323 | U | | 6/2014 | |
| CN | 302934338 | | | 9/2014 | |
| CN | 302934353 | | | 9/2014 | |
| CN | 203987000 | U | | 12/2014 | |
| CN | 203987001 | U | | 12/2014 | |
| CN | 204105339 | U | | 1/2015 | |
| CN | 303079159 | | | 1/2015 | |
| CN | 204218375 | U | | 3/2015 | |
| CN | 204378525 | U | | 6/2015 | |
| CN | 204561513 | U | | 8/2015 | |
| CN | 204734179 | U | | 11/2015 | |
| CN | 303501418 | | | 12/2015 | |
| CN | 105266439 | A | | 1/2016 | |
| CN | 205144034 | U | | 4/2016 | |
| CN | 105581540 | A | | 5/2016 | |
| CN | 205197532 | U | | 5/2016 | |
| CN | 205197533 | U | | 5/2016 | |
| CN | 205250945 | U | | 5/2016 | |
| CN | 303673854 | | | 5/2016 | |
| CN | 205306448 | U | | 6/2016 | |
| CN | 303706845 | | | 6/2016 | |
| CN | 303715019 | S | | 6/2016 | |
| CN | 205386000 | U | | 7/2016 | |
| CN | 205410425 | U | | 8/2016 | |
| CN | 205432888 | U | | 8/2016 | |
| CN | 205513523 | U | | 8/2016 | |
| CN | 303909615 | | | 11/2016 | |
| CN | 205923494 | U | | 2/2017 | |
| CN | 106617832 | A | | 5/2017 | |
| CN | 206342191 | U | | 7/2017 | |
| CN | 304259396 | | | 8/2017 | |
| CN | 107149318 | A | | 9/2017 | |
| CN | 107183980 | A | | 9/2017 | |
| CN | 304366086 | | | 11/2017 | |
| CN | 304366089 | | | 11/2017 | |
| CN | 104042052 | B | | 12/2017 | |
| CN | 304470127 | | | 1/2018 | |
| CN | 304479478 | S | | 1/2018 | |
| CN | 304675444 | | | 6/2018 | |
| CN | 207626870 | U | | 7/2018 | |
| CN | 207653874 | U | | 7/2018 | |
| CN | 207653880 | U | | 7/2018 | |
| CN | 207707597 | U | | 8/2018 | |
| CN | 207837200 | U | | 9/2018 | |
| CN | 207837201 | U | | 9/2018 | |
| CN | 304915867 | | | 11/2018 | |
| CN | 208318773 | U | | 1/2019 | |
| CN | 304995356 | | | 1/2019 | |
| CN | 208540946 | U | | 2/2019 | |
| CN | 208610251 | U | | 3/2019 | |
| CN | 305117619 | | | 4/2019 | |
| CN | 208807904 | U | | 5/2019 | |
| CN | 208837396 | U | * | 5/2019 | |
| CN | 305144548 | | | 5/2019 | |
| CN | 305151099 | | | 5/2019 | |
| CN | 305184518 | | | 5/2019 | |
| CN | 305184743 | | | 5/2019 | |
| CN | 305192101 | S | | 6/2019 | |
| CN | 209121601 | U | | 7/2019 | |
| CN | 305278154 | | | 7/2019 | |
| CN | 305278199 | | | 7/2019 | |
| CN | 209202449 | U | | 8/2019 | |
| CN | 209284651 | U | | 8/2019 | |
| CN | 305288779 | | | 8/2019 | |
| CN | 305319453 | | | 8/2019 | |
| CN | 110248571 | A | | 9/2019 | |
| CN | 305387525 | | | 10/2019 | |
| CN | 209563815 | U | | 11/2019 | |
| CN | 305410948 | | | 11/2019 | |
| CN | 209733152 | U | | 12/2019 | |
| CN | 305476269 | | | 12/2019 | |
| CN | 305476270 | | | 12/2019 | |
| CN | 305476271 | | | 12/2019 | |
| CN | 305482341 | | | 12/2019 | |
| CN | 210130606 | U | | 3/2020 | |
| CN | 305665643 | | | 3/2020 | |
| CN | 305665814 | | | 3/2020 | |
| CN | 210227485 | U | | 4/2020 | |
| CN | 305720141 | | | 4/2020 | |
| CN | 305730506 | | | 4/2020 | |
| CN | 111096592 | A | | 5/2020 | |
| CN | 111109911 | A | | 5/2020 | |
| CN | 210471557 | U | | 5/2020 | |
| CN | 305754282 | | | 5/2020 | |
| CN | 111436785 | A | | 7/2020 | |
| CN | 211048875 | U | | 7/2020 | |
| CN | 305916756 | S | | 7/2020 | |
| CN | 211323950 | U | | 8/2020 | |
| CN | 305992763 | | | 8/2020 | |
| CN | 306000652 | | | 8/2020 | |
| CN | 306171557 | | | 11/2020 | |
| CN | 306185745 | | | 11/2020 | |
| CN | 306356199 | | | 3/2021 | |
| CN | 306362131 | | | 3/2021 | |
| CN | 306370791 | | | 3/2021 | |
| CN | 306436478 | | | 4/2021 | |
| CN | 306517482 | | | 5/2021 | |
| CN | 306517542 | | | 5/2021 | |
| DE | 1554097 | A1 | * | 11/1969 | ..... A47C 1/0265 |
| DE | 1812091 | A1 | * | 6/1970 | ..... A47C 5/10 |
| DE | 2842338 | A1 | * | 4/1980 | ..... A47C 4/12 |
| DE | 29701385 | U1 | * | 5/1998 | ..... A47C 1/026 |
| DE | 19839166 | C1 | * | 12/1999 | ..... A47C 7/282 |
| DE | 20103397 | U1 | | 5/2001 | |
| DE | 202016103648 | U1 | * | 8/2016 | ..... A47C 17/70 |
| DE | 102016100825 | A1 | * | 7/2017 | ..... A47C 1/0265 |
| DE | 102016122681 | A1 | * | 5/2018 | ..... A47C 1/0265 |
| DE | 202019104071 | U1 | | 8/2019 | |
| EM | 000196985-0001 | | | 10/2004 | |
| EM | 001752718-0001 | | | 9/2010 | |
| EM | 02274159-0005 | | | 7/2013 | |
| EM | 002290171-0004 | | | 8/2013 | |
| EM | 002523522-0002 | | | 9/2014 | |
| EM | 002523936-0001 | | | 9/2014 | |
| EM | 002631614-0007 | | | 2/2015 | |
| EM | 002631614-0008 | | | 2/2015 | |
| EM | 003309384-0011 | | | 7/2016 | |
| EM | 005505070-0005 | | | 8/2018 | |
| EM | 005621034-0001 | | | 9/2018 | |
| EM | 003357953-0001 | | | 4/2019 | |
| EM | 006595443-0001 | | | 6/2019 | |
| EM | 007308622-0001 | | | 12/2019 | |
| EM | 007418512-0001 | | | 3/2020 | |
| EM | 007418512-0002 | | | 3/2020 | |
| EM | 007772918-0001 | | | 3/2020 | |
| EM | 007822762-0002 | | | 5/2020 | |
| EM | 008012678-0001 | | | 9/2020 | |
| EM | 006624128-0001 | | | 11/2020 | |
| EM | 008324966-0002 | | | 12/2020 | |
| EM | 008430615-0001 | | | 2/2021 | |
| EM | 008430615-0002 | | | 2/2021 | |
| EM | 008430615-0003 | | | 2/2021 | |
| EM | 008430615-0004 | | | 2/2021 | |
| EM | 008405476-0003 | | | 4/2021 | |
| EP | 0133940 | A2 | | 3/1985 | |
| EP | 0399893 | A1 | | 11/1990 | |
| EP | 0925745 | A1 | | 6/1999 | |
| EP | 0976347 | A2 | | 2/2000 | |
| EP | 1002485 | A1 | * | 5/2000 | ..... A47C 4/30 |
| EP | 1410735 | A1 | | 4/2004 | |
| EP | 1504698 | A1 | * | 2/2005 | ..... A47C 7/282 |
| EP | 1579786 | A1 | | 9/2005 | |
| EP | 2820974 | A1 | * | 1/2015 | ..... A47C 1/0265 |

(56) References Cited

FOREIGN PATENT DOCUMENTS

| | | | | | |
|---|---|---|---|---|---|
| EP | 002735472-0004 | | | 7/2015 | |
| EP | 2792275 | B1 | | 2/2016 | |
| FR | 1149065 | A | * | 12/1957 | ..... A47C 4/30 |
| FR | 2623986 | A | * | 6/1989 | ..... A47C 1/0265 |
| FR | 2747286 | A1 | | 10/1997 | |
| GB | 318354 | A | | 9/1929 | |
| GB | 444159 | A | * | 3/1936 | ..... A47C 4/40 |
| GB | 652597 | A | * | 4/1951 | ..... A47C 4/42 |
| GB | 657016 | A | * | 9/1951 | ..... A47C 4/30 |
| GB | 1336856 | A | | 11/1973 | |
| GB | 2292679 | A | | 3/1996 | |
| GB | 3007610 | | | 10/2002 | |
| JP | D1089589 | | | 10/2000 | |
| JP | D1099313 | | | 2/2001 | |
| JP | 2002142906 | A | | 5/2002 | |
| JP | 2002165667 | A | | 6/2002 | |
| JP | 2002233429 | A | | 8/2002 | |
| JP | D1150865 | | | 8/2002 | |
| JP | D1207408 | | | 6/2004 | |
| JP | D1207987 | | | 6/2004 | |
| JP | D1209046 | | | 6/2004 | |
| JP | 3862211 | B2 | | 12/2006 | |
| JP | D1302363 | | | 6/2007 | |
| JP | D1376566 | | | 12/2009 | |
| JP | D1398438 | | | 10/2010 | |
| JP | D1398447 | | | 10/2010 | |
| JP | D1398856 | | | 10/2010 | |
| JP | D1398858 | | | 10/2010 | |
| JP | D1401181 | | | 11/2010 | |
| JP | D1401538 | | | 11/2010 | |
| JP | D1405698 | | | 1/2011 | |
| JP | D1405699 | | | 1/2011 | |
| JP | D1413797 | | | 5/2011 | |
| JP | D1423191 | | | 9/2011 | |
| JP | 5079403 | B2 | | 11/2012 | |
| JP | D1491010 | | | 2/2014 | |
| JP | D1494757 | | | 4/2014 | |
| JP | D1494758 | | | 4/2014 | |
| JP | D1495773 | | | 4/2014 | |
| JP | D1495888 | | | 4/2014 | |
| JP | 5802090 | B2 | | 10/2015 | |
| JP | D1539901 | | | 12/2015 | |
| JP | D1549375 | | | 5/2016 | |
| JP | 5972432 | B2 | | 8/2016 | |
| JP | 6163332 | B2 | | 7/2017 | |
| JP | D1596566 | | | 2/2018 | |
| JP | D1629214 | | | 4/2019 | |
| JP | D1550241 | | | 5/2019 | |
| JP | D1550242 | | | 5/2019 | |
| JP | D1664310 | | | 7/2020 | |
| JP | D1664311 | | | 7/2020 | |
| JP | D1667103 | | | 8/2020 | |
| JP | 2021062019 | A | | 4/2021 | |
| KR | 200427731 | Y1 | | 9/2006 | |
| KR | 101121652 | B1 | | 3/2012 | |
| KR | 20130004781 | U | | 8/2013 | |
| KR | 101506728 | B1 | | 3/2015 | |
| KR | 101589829 | B1 | | 2/2016 | |
| KR | 102055450 | B1 | | 12/2019 | |
| KR | 20200001349 | U | | 6/2020 | |
| KR | 20200071546 | A | | 6/2020 | |
| NL | 7403586 | A | * | 10/1974 | ..... A47C 1/0265 |
| WO | 1985003208 | A1 | | 8/1985 | |
| WO | 1989010712 | A1 | | 11/1989 | |
| WO | 1997027786 | A1 | | 8/1997 | |
| WO | 1998002064 | A1 | | 1/1998 | |
| WO | D043845-020 | | | 7/1998 | |
| WO | D044064-013 | | | 7/1998 | |
| WO | 2000021415 | A1 | | 4/2000 | |
| WO | D054796-001 | | | 3/2001 | |
| WO | D054796-004 | | | 3/2001 | |
| WO | D058878-008 | | | 1/2002 | |
| WO | 2002017750 | A1 | | 3/2002 | |
| WO | D064503-049 | | | 10/2003 | |
| WO | 2007099376 | A2 | | 9/2007 | |
| WO | 2008011749 | A1 | | 1/2008 | |
| WO | D074604-019 | | | 10/2010 | |
| WO | 2013023365 | A1 | | 2/2013 | |
| WO | 2013029089 | A1 | | 3/2013 | |
| WO | D064503-011 | | | 10/2013 | |
| WO | D064503-051 | | | 10/2013 | |
| WO | 2015196575 | A1 | | 12/2015 | |
| WO | 2015199404 | A1 | | 12/2015 | |
| WO | 2018213610 | A1 | | 11/2018 | |

OTHER PUBLICATIONS 2 page PDF of machine translation of DE 1554097A1. (Year: 1969).*

2 page PDF of machine translation of DE 1812091A. (Year: 1970).*

8 page PDF of machine translation of EP 1002485A1. (Year: 2000).*

2 page PDF of machine translation of FR 1149065A. (Year: 1957).*

Oct. 19, 2020—(WO) International Search Report & Written Opinion—PCT/US20/035942.

* cited by examiner

PORTABLE CHAIR

CROSS-REFERENCE TO RELATED APPLICATIONS

This application claims priority to U.S. Provisional Application No. 62/857,001 filed on Jun. 4, 2019. The above referenced application is incorporated by reference in its entirety.

FIELD OF THE INVENTION

This disclosure relates to portable chairs. More specifically, aspects of this disclosure relate to portable and collapsible chairs.

BACKGROUND

Portable chairs are commonly used during events and activities where seating is desirable, but not always provided, such as tailgating, camping, going to the beach, and other outdoor activities. In most cases, the chairs may be uncomfortable and have limited ability to adjust the seating position. Additionally, the chairs may have poor durability reducing the long-term viability of the chair. Accordingly, overall user satisfaction with some portable chairs is low and the frequency of replacement is high.

BRIEF SUMMARY

The following presents a simplified summary of various aspects described herein. This summary is not an extensive overview, and is not intended to identify key or critical elements or to delineate the scope of the claims. The following summary merely presents some concepts in a simplified form as an introductory prelude to the more detailed description provided below.

This disclosure may relate to a portable chair that includes a first front leg and a second front leg connected by a front sled; a first back leg and a second back leg connected by a back sled; a seat frame that includes a forward rail, a rear rail opposite the forward rail, a first seat side rail extending between the forward rail and the rear rail, and a second seat side rail extending between the forward rail and the rear rail opposite the first seat side rail, and a back frame including a top rail, a first back side rail extending downward from the top rail, and a second back side rail extending downward from the top rail opposite the first back side rail. The chair also includes a fabric member releasably connected to the seat frame and the back frame, where the fabric member extends from the forward rail to the top rail, and an armrest that includes an armrest body that is pivotally connected to the back frame at a rear end portion, and a control assembly. The control assembly may be connected to the armrest body and include a sliding pivot that is pivotally attached to the first front leg and the first back leg and is also slidably engaged with the armrest. A rearward movement of the sliding pivot may cause the portable chair to move from an upright position to a reclined position, and the chair may have a folded position and an unfolded position. The sliding pivot may include a first set of engaging teeth that engage with a second set of engaging teeth to secure the sliding pivot in a fixed location relative to the armrest body. In addition, the control assembly may also include a side paddle that is pivotally attached to the armrest body such that when the side paddle is rotated inward, the second set of engaging teeth disengage from the first set of engaging teeth to allow the sliding pivot to move relative to the armrest body. The side paddle may also include an actuation portion that receives contact from a user, a receiver that defines a rotational axis and receives a pin, and an engaging portion, where the actuation portion and engaging portion are positioned substantially perpendicular to each other. The second set of engaging teeth may be attached to the engaging portion of the side paddle. The side paddle may be positioned on an outboard side of the armrest. The sliding pivot may slide along a guide rail positioned along a bottom of the armrest body. In some instance, the guide rail is integrally formed with the armrest body.

Other aspects of this disclosure may relate to a portable chair that includes a first back leg extension is positioned between the first back leg and the back sled and a second back leg extension is positioned between the second back leg and the back sled, where the first back leg extension extends in a different direction than the first back leg. The first back leg extension may form an obtuse angle with the first back leg. In some examples, the fabric member may include a plurality of side portions, where each side portion of the plurality of side portions is secured to one of the first side seat rail, the second side seat rail, the first back side rail, and the second back side rail using a plurality of fabric retention members. The plurality of fabric retention members may include a plurality of complementary mechanical fasteners, where each complementary mechanical fastener includes a first mechanical element and a second mechanical element that connect together to form a releasable connection. The first side seat rail may include a first set of first mechanical elements and the second side seat rail includes a second set of first mechanical elements that face each other.

Still other aspects of this disclosure may relate to a portable chair that includes a first front leg and a second front leg connected by a front sled; a first back leg and a second back leg connected by a back sled; a seat frame including a forward rail, a rear rail opposite the forward rail, a first seat side rail extending between the forward rail and the rear rail, and a second seat side rail extending between the forward rail and the rear rail opposite the first seat side rail, and a back frame including a top rail, a first back side rail extending downward from the top rail, and a second back side rail extending downward from the top rail opposite the first back side rail. The chair may have a fabric member releasably connected to the seat frame and the back frame, where the fabric member extends continuously from the forward rail to the top rail. The fabric member may be connected to the seat frame and to the back frame using a plurality of complementary mechanical fasteners. The chair may also include an armrest that includes an armrest body that is pivotally connected to the back frame at a rear end portion, and a control assembly connected to the armrest body. The control assembly may include a sliding pivot pivotally attached to the first front leg and the first back leg and also slidably engaged with the armrest, where the sliding pivot includes a first set of engaging teeth. The control assembly may also include a side paddle pivotally attached to the armrest body, where the side paddle includes a second set of engaging teeth that engages with the first set of engaging teeth to secure the sliding pivot in a fixed location relative to the armrest body. In addition, at least one resilient member may be positioned between the side paddle and the armrest body, where the at least one resilient member exerts a force on the side paddle to keep the second set of engaging teeth in contact with the first set of engaging teeth. When the side paddle is rotated inward, the second set of engaging teeth may disengage from the first set of engaging teeth to allow the sliding pivot to move relative to the armrest body causing the portable chair to move from an upright position to a reclined position. The second set of engaging teeth may have at least one tooth with a chamfered outboard edge.

a portable chair comprising a first front leg and a second front leg connected by a front sled, a first back leg and a second back leg connected by a back sled, a seat frame pivotally engaged with the first front leg and the second front leg, where the seat frame including a forward rail, a rear rail opposite the forward rail, a first seat side rail extending between the forward rail and the rear rail, and a second seat side rail extending between the forward rail and the rear rail opposite the first seat side rail. A fabric retention member may be attached to the seat frame, where the fabric retention member includes a rounded exterior surface, a first interior cavity, and a second interior cavity. The first interior cavity of the fabric retention member may engage a portion of the seat frame. A fabric member may have a first end secured to the back frame by the fabric retention member, where the fabric member wraps around the rounded exterior surface of the fabric retention member before extending across an unsupported region of the seat frame. The first end of the fabric member may be secured in a second interior cavity of the fabric retention member, where the first end of the fabric member has a loop that receives a rod to secure the fabric member in the fabric retention member. The first interior cavity may have a partial cylindrical shape and the second interior cavity has a partial cylindrical shape, and wherein the first interior cavity has a larger radius than the second interior cavity. In addition, the first interior cavity may have a partial cylindrical shape that when measured in a cross-sectional view extends between a range of 120 degrees and 240 degrees.

Additional aspects of this disclosure may relate to a portable chair having a fabric retention member where the first interior cavity of the fabric retention member may include a first opening that extends an overall length of the fabric retention member, and a second interior cavity that includes a second opening that extends the overall length of the fabric retention member of the second inner. An angle may be formed by a line segment extending from a center of the second interior cavity through a midpoint of the second opening and a line segment extending through a center of the first interior cavity through a midpoint of the first opening, where the angle is between 15 degrees and 150 degrees. The first end of the fabric member may have a loop that receives a rod to secure the fabric member in the fabric retention member, and where a width across the second opening is less than a diameter of the rod. An outboard edge adjacent the second opening may have a substantially rounded shape, where a radius of the outboard edge is at least ten times a thickness of the fabric member. The fabric member may wrap around the outboard edge and also around the rounded exterior surface before extending across an unsupported region of the back frame.

Other aspects of this disclosure may also relate to a portable chair comprising a back assembly, wherein the back assembly includes a second fabric member secured to the back frame by a second fabric retention member and a back frame comprising a top rail, a first back side rail extending from the top rail, and a second back side rail extending from the top rail opposite the first side back rail. The portable chair may also comprise an armrest having a sliding pivot attached to the first front leg and the first back leg that is slidably engaged with the armrest, and the armrest having a back end pivotally connected to the back frame, where a rearward movement of the sliding pivot causes the portable chair to move from an upright position to a reclined position.

Still other aspects of this disclosure may relate to a portable chair comprising a first front leg and a second front leg connected by a front sled, a first back leg and a second back leg connected by a back sled, a seat frame including a forward rail, a rear rail opposite the forward rail, a first seat side rail extending between the forward rail and the rear rail, and a second seat side rail extending between the forward rail and the rear rail opposite the first seat side rail, and a first fabric retention member attached to the seat frame, where the first fabric retention member secures a first fabric member to the seat frame. The chair may have a back frame including a top rail, a first back side rail extending downward from the top rail, and a second back side rail extending downward from the top rail opposite the first rail, a second fabric retention member attached to the back frame, where the second fabric retention member secures a second fabric member to the back frame, and where each fabric retention member of the first and the second fabric retention members include a rounded exterior surface. The first fabric member may wrap around the rounded exterior surface of the first fabric retention member before extending to an unsupported region of the seat frame, and the second fabric member may wrap around the rounded exterior surface of the second fabric retention member before extending to an unsupported region of the back frame. The chair may further include an armrest having a sliding pivot attached to the first front leg and the first back leg that is slidably engaged with the armrest, and a back end pivotally connected to the back frame, wherein a rearward movement of the sliding pivot causes the portable chair to move from an upright position to a reclined position. The sliding pivot may include a plurality of engaging teeth that engage with a plurality of engaging teeth located on a bottom surface of the armrest to secure the sliding pivot in a fixed location relative to the armrest. In addition, the armrest may include a side paddle that is pivotally attached to the armrest such that when the side paddle is rotated inward, the plurality of engaging teeth located on the bottom surface of the armrest disengage from the plurality of engaging teeth on the sliding pivot to allow the sliding pivot to move relative to the armrest. The first fabric retention member may comprise a first interior cavity, and a second interior cavity, where the first interior cavity engages a portion of the seat frame. The first interior cavity may include a first opening that extends an overall length of the fabric retention member, and the second interior cavity may include a second opening that extends the overall length of the fabric retention member of the second inner. An angle may be formed by a line segment extending from a center of the second interior cavity through a midpoint of the second opening and a line segment extending through a center of the first interior cavity through a midpoint of the first opening, where the angle is between 15 degrees and 150 degrees.

Yet in other aspects of this disclosure may relate to a portable chair comprising a first front leg and a second front leg connected by a front sled, a first back leg and a second back leg connected by a back sled, and a first armrest pivotally connected to a first armrest support near a forward end of the first armrest and wherein a rear end of the first armrest is pivotally connected to a back frame; wherein the first armrest support comprises a first end and a second end, wherein the first end is pivotally connected to the first armrest and the second end is pivotally connected to a seat frame. The back frame may include a top rail, a first back side rail extending downward from the top rail, and a second back side rail extending downward from the top rail opposite the first rail. A fabric retention member may be attached to the back frame, where the fabric retention member includes a rounded exterior surface, a first interior cavity, and a second interior cavity, where the first interior cavity engages a portion of the back frame. A fabric member may comprise a first end secured to the back frame by the fabric retention member, where the fabric member wraps around the rounded exterior surface of the fabric retention member before extending across an unsupported region of the back frame. The first interior cavity may include a first opening that extends an overall length of the fabric retention member, and the second interior cavity includes a second opening that extends the overall length of the fabric retention member of the second inner. An angle is formed by a line segment extending from a center of the second interior cavity through a midpoint of the second opening and a line segment extending through a center of the first interior cavity through a midpoint of the first opening, where the angle is between 15 degrees and 150 degrees. The first end of the fabric member has a loop that receives a rod to secure the fabric member in the fabric retention member, and wherein a width across the second opening is less than a diameter of the rod. An outboard edge adjacent the second opening has a substantially rounded shape, where a radius of the outboard edge is at least ten times a thickness of the fabric member and where the fabric member wraps around the outboard edge and around the exterior rounded surface before extending across an unsupported region of the back frame.

DETAILED DESCRIPTION

In the following description of various example structures according to the invention, reference is made to the accompanying drawings, which form a part hereof, and in which are shown by way of illustration various example devices, systems, and environments in which aspects of the invention may be practiced. It is to be understood that other specific arrangements of parts, example devices, systems, and environments may be utilized and structural and functional modifications may be made without departing from the scope of the present invention.

Also, while the terms "top," "bottom," "front," "back," "side," "rear," and the like may be used in this specification to describe various example features and elements of the invention, these terms are used herein as a matter of convenience, e.g., based on the example orientations shown in the figures or the orientation during typical use. Additionally, the term "plurality," as used herein, indicates any number greater than one, either disjunctively or conjunctively, as necessary, up to an infinite number. The term "pivotally connected" or "pivotally joined" as used herein, indicates that the components or features are joined such that the components can rotate relative to each other while still being connected. Examples of a "pivotally connected" or "pivotally joined" may include a pin inserted into an opening arranged in each of the components to "pivotally connect" the components. Nothing in this specification should be construed as requiring a specific three dimensional orientation of structures in order to fall within the scope of this invention. The reader is advised that the attached drawings are not necessarily drawn to scale.

Generally, this disclosure generally relates to a portable chair that has an unfolded or use position and a folded or transport position. The portable chair may be easily folded and carried by a user to any location and then easily be unfolded to provide comfortable seating.

Figure 1:
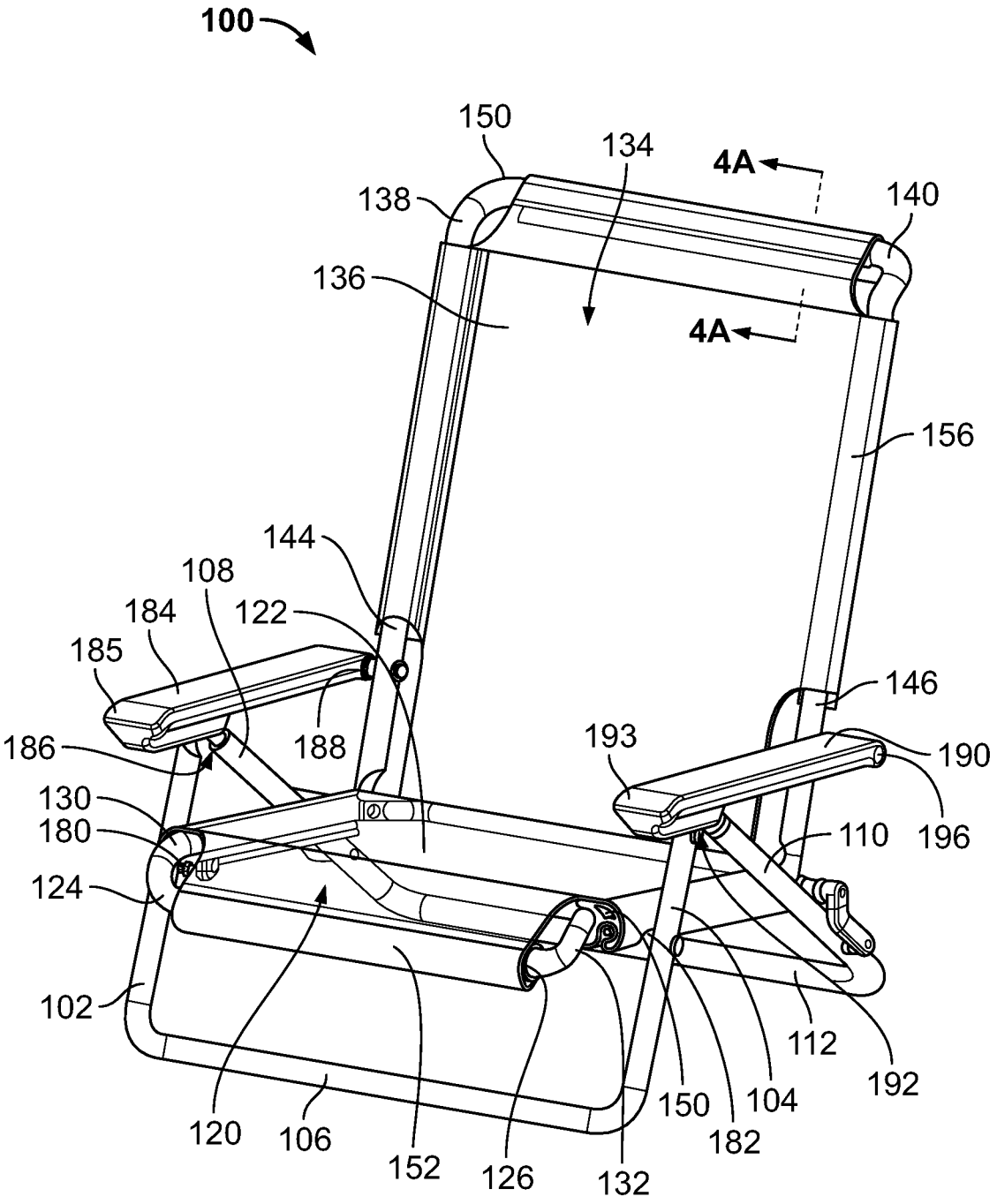
FIG. 1 is a top front perspective view of the portable chair in an upright position according to aspects disclosed herein.
Figure 7:
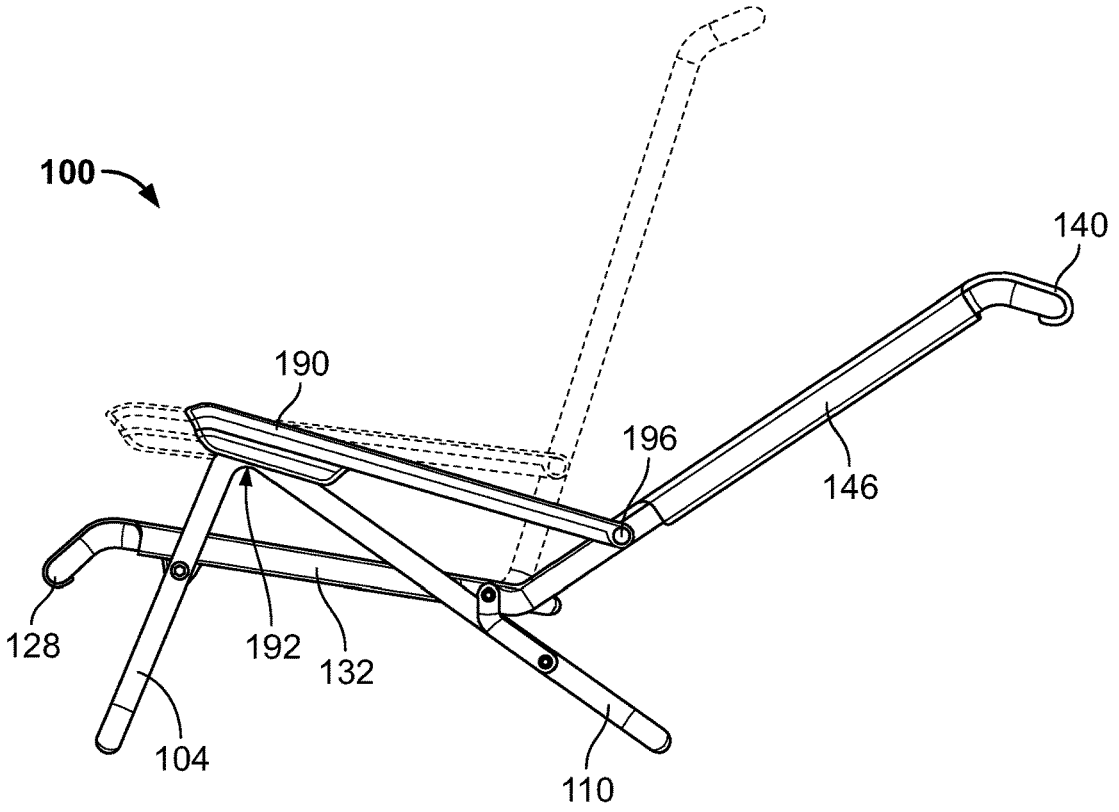
FIG. 7 is a side view of the portable chair of FIG. 1 in a reclined position according to aspects disclosed herein.
Figure 8:
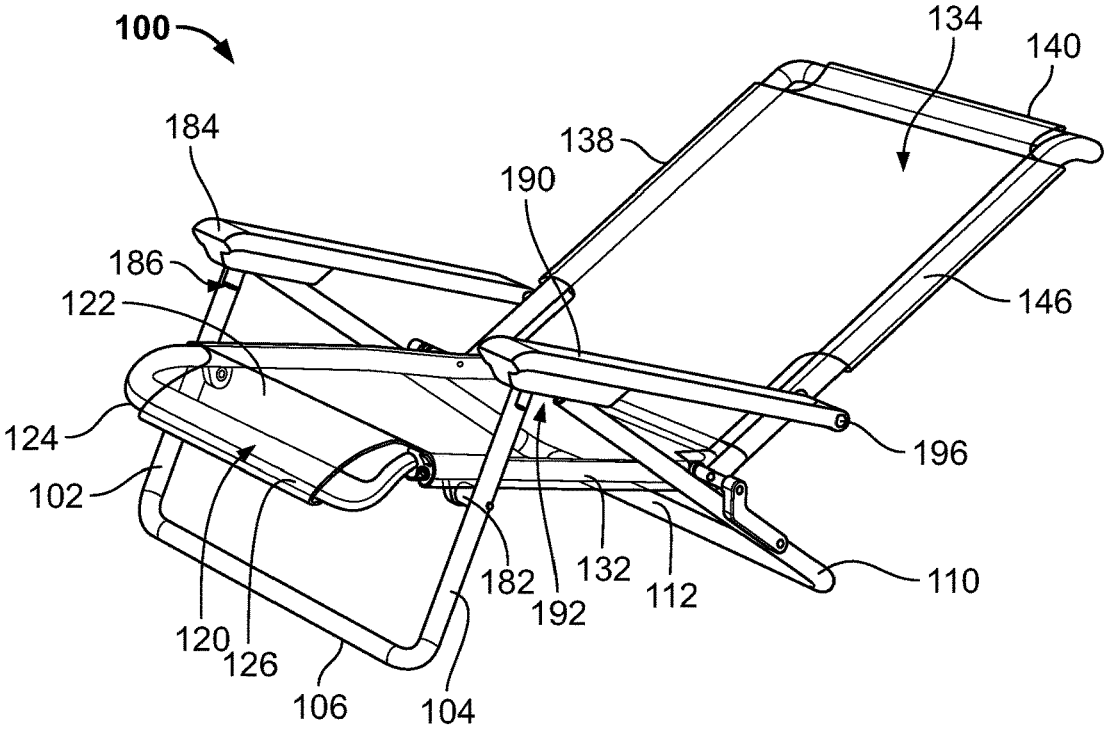
FIG. 8 is a top front perspective view of the portable chair of FIG. 1 in a reclined position according to aspects disclosed herein.

As shown in FIGS. 1, 7, and 8, the portable chair 100 may comprise a first front leg 102 and a second front leg 104 connected by a front sled 106, a first back leg 108 and a second back leg 110 connected by a back sled 112, a seat assembly 120, and a back assembly 134. The seat assembly 120 may further include front leg attachment portions 180, 182 to pivotally connect and/or fasten the front legs 102, 104, respectively, to the seat assembly 120. In addition, the portable chair 100 may include a first armrest 184 that is a pivotally connected to the first front leg 102 and the first back leg 108 at a sliding pivot 186 near the front end 185 of the armrest 184 and also pivotally connected to the back assembly 134 at a second connection point 188 near the rear end of the first armrest 184. Similarly, a second armrest 190 may also be pivotally connected to the second front leg 104 and the second back leg 110 at a sliding pivot 192 near the front end 193 of the armrest 190 and also pivotally connected to the back assembly 134 at a second connection point 196 the rear end of the second armrest 190. Additionally, chair 100 may be of a symmetric construction where components on a left side of the chair 100 (i.e. front leg 104) may be mirrored to the components of the right side of the chair 100 (i.e. front leg 102).

The seat assembly 120 may include a seat fabric member 122 and a seat frame 124, where the seat frame 124 includes a forward rail 126, a rear rail 128 opposite the forward rail 126, a first side seat rail 130 extending between the forward rail 126 and the rear rail 128, and a second seat side rail 132 extending between the forward rail 126 and the rear rail 128 opposite the first side seat rail 130. The back assembly 134 may include a back fabric member 136 and a back frame 138, where the back frame 138 includes a top rail 140, a first side back rail 144 extending downward from the top rail 140, and a second side back rail 146 downward from the top rail 140 opposite the first side back rail 144.

The seat fabric member 122 and the back fabric member 136 may be secured to the seat frame 124 and the back frame 138 respectively with a plurality of fabric retention members 150. For example, the seat fabric member 122 may have a plurality of sides 152, such that each side 152 has an end portion 154 that is secured to each of the forward rail 126, rear rail 128, the first side seat rail 130, and the second side seat rail 132 respectively using a fabric retention member 150. Similarly, the back fabric member 136 may have a plurality of sides 156, such that each side 156 has an end portion 158 that is secured to each of the top rail 140, the first side back rail 144, and the second side back rail 146 using fabric retention member 150.

Figure 2:
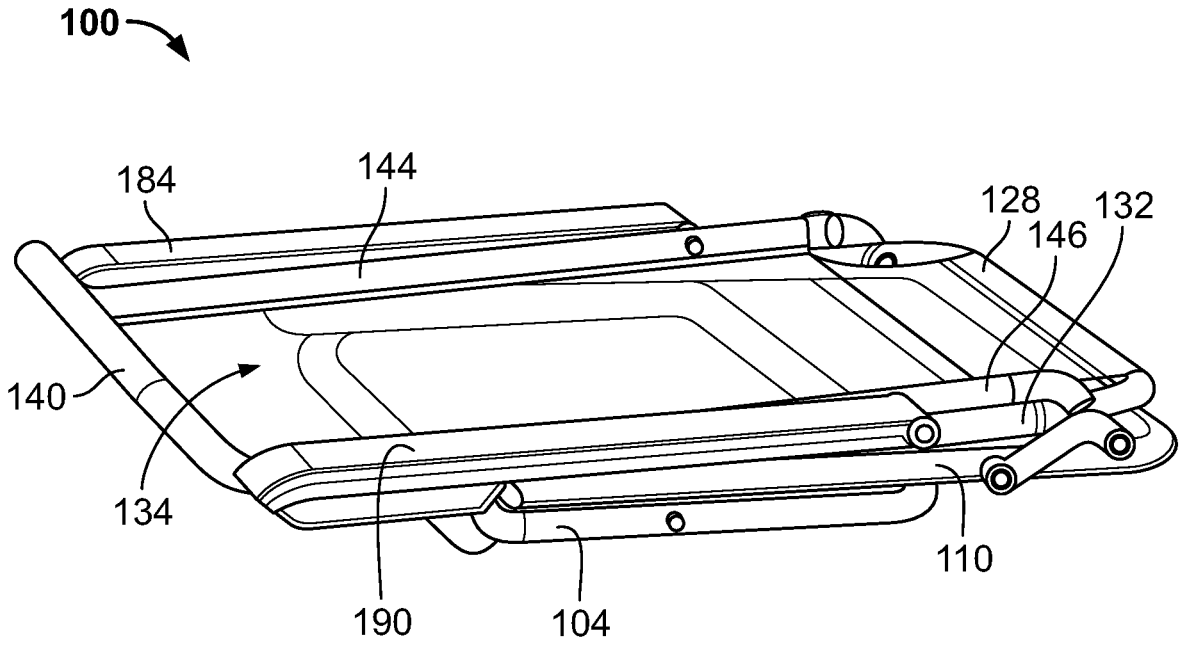
FIG. 2 is a top front perspective view of the portable chair of FIG. 1 in a folded configuration according to aspects disclosed herein.
Figure 3:
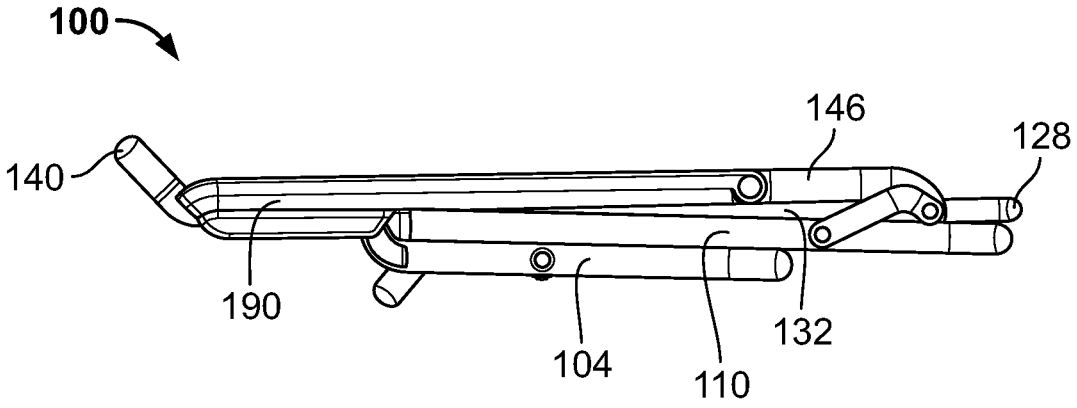
FIG. 3 is a side view of the portable chair of FIG. 1 in a folded configuration according to aspects disclosed herein.

The chair 100 may be easily converted from the use position shown in FIG. 1 to a folded position shown in FIGS. 2 and 3 for easy transport to another location or for storage. Through actuation of the rotational and pivotable interfaces, portable chair 100 may be folded into a portable position as shown in FIGS. 2 and 3 and unfolded into a seating position as shown in FIG. 1. While in the folded portable position, the chair 100 may be locked and/or sustained in the folded portable position by one or more detents. The one or more detents may provide resistance against the opening of the chair 100 from the folded portable position into the unfolded seating position. While in the unfolded seating position, the one or more detents may additionally provide resistance against the closing of the chair 100 from the unfolded seating position into the folded portable position.

For further example, chair 100 may be configured to open from a folded portable position into an unfolded seating position. In the folded portable position, the front legs 102, 104 may be substantially parallel to back legs 108, 110 and seat assembly 120 may be substantially parallel to back assembly 134. Additionally and/or alternatively, the one or more detents may be included in the attachment interface between front legs 102, 104 and the front leg attachment portions 180, 182.

The two front legs 102, 104, the two back legs 108, 110, the front sled 106, the back sled 112 along with the rails of the seat frame 124 and back frame 138 may be cylindrical rods, tubes, and/or shafts, or other hollow shape. The front legs 102, 104 and front sled 106 may be formed as a single member. Similarly, the back legs 108, 110 and back sled 112 may be formed as a single member. These components may be made of, for example, aluminum, titanium, stainless steel, scandium, metal alloys, polymers, composites, carbon fiber, and/or wood, such as bamboo. In instances in which aluminum, titanium, stainless steel, scandium, and/or metal alloys are used in the fabrication of the two front legs 102, 104, the two back legs 108, 110, the front sled 106, the back sled 112 along with the rails of the seat frame 124 and back frame 138, the metallic components may be hydroformed, cast, or formed by another method known to one skilled in the art. Furthermore, the metallic components may be treated through anodizing, plating, painting, powder coating, and/or the application of enamel in order to prevent corrosion induced by environmental conditions such as salt spray. Additionally, the metals and alloys used in the fabrication of the legs 102, 104, 108, 110, the sleds 106, 112, and the rails of the frames 124, 138 may be treated through annealing, case hardening, precipitation strengthening, tempering, normalizing, and/or quenching in order to increase hardness, toughness, and tensile and shear strength.

Figure 4A:
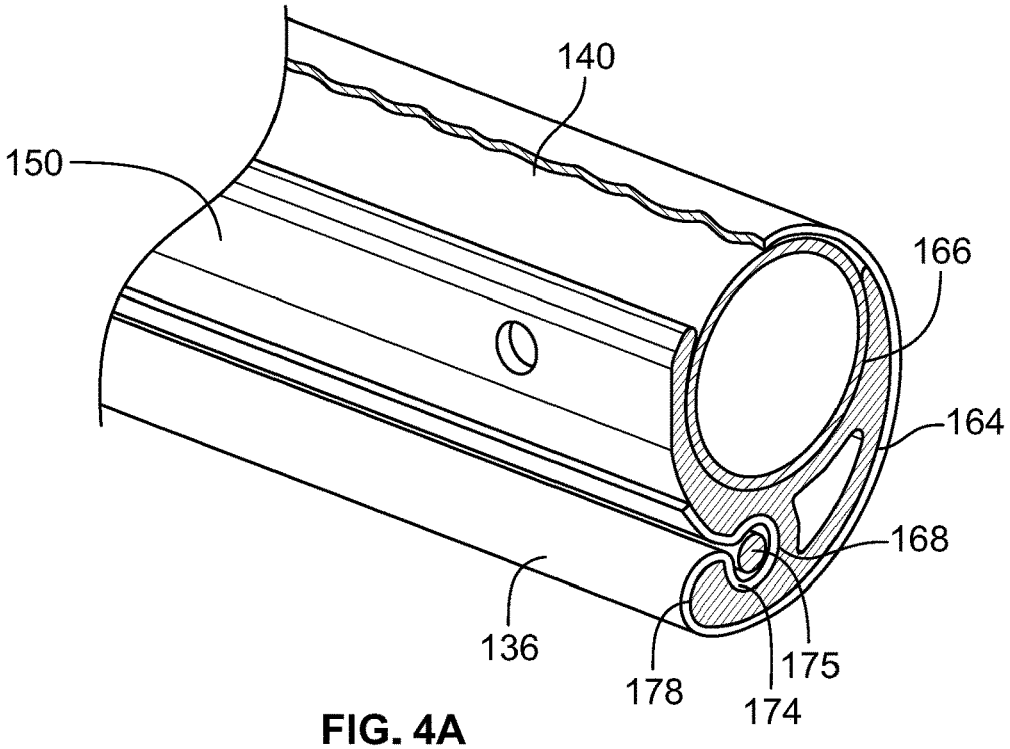
FIG. 4A is an enlarged partial cross-sectional perspective view of the portable chair of FIG. 1 according to aspects disclosed herein.
Figure 5A:
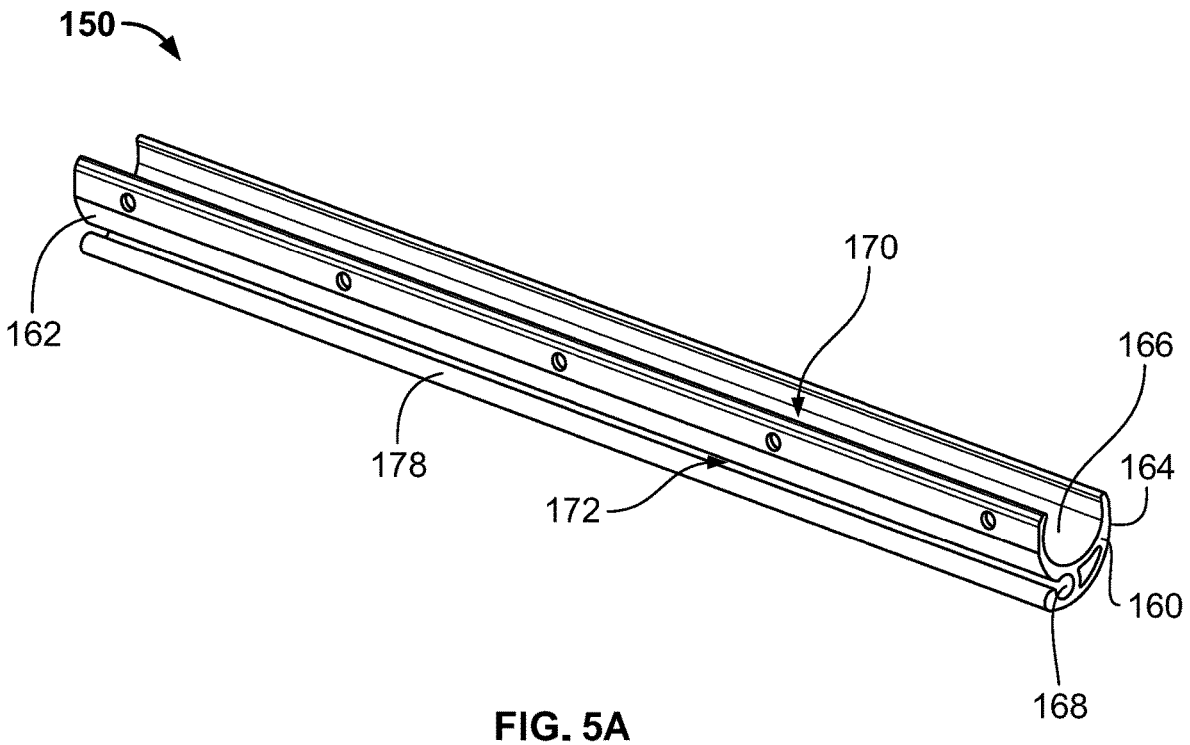
FIG. 5A is a perspective view of the fabric retention member of the portable chair of FIG. 1 according to aspects disclosed herein.
Figure 5B:
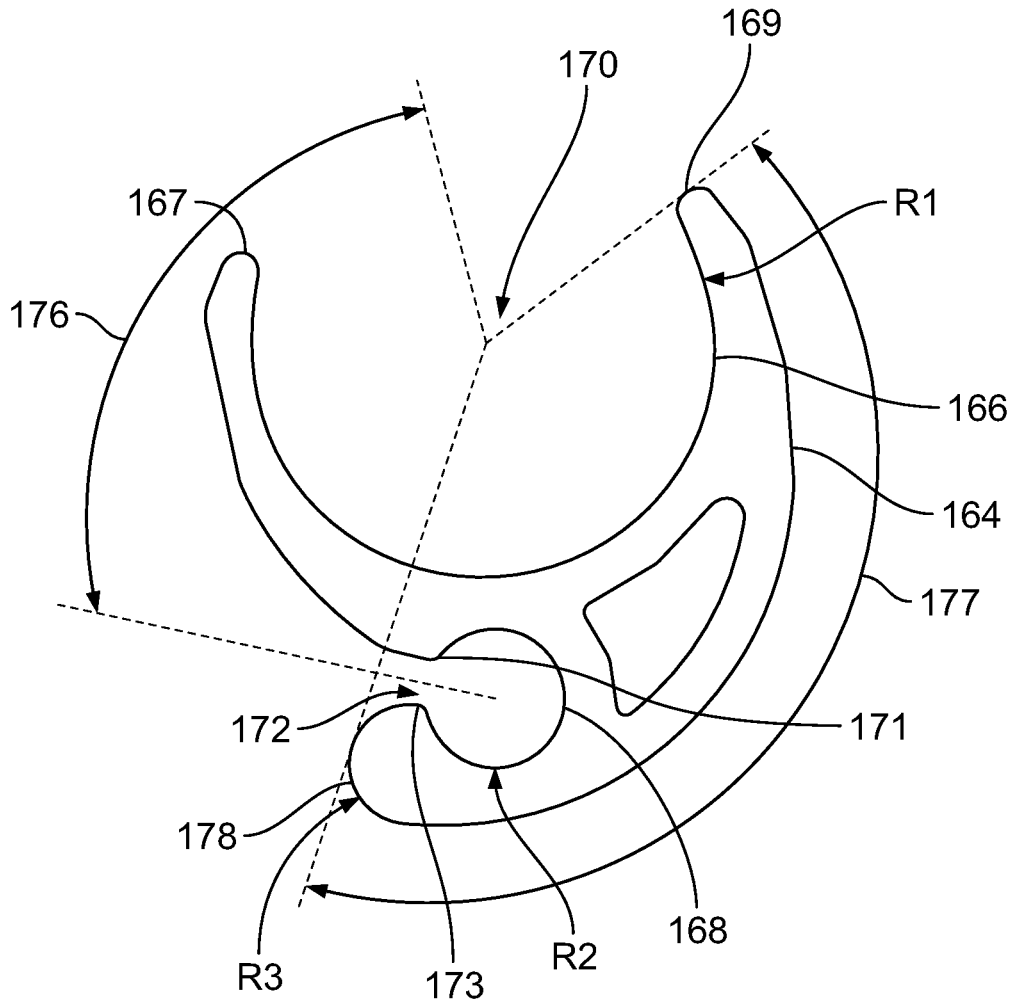
FIG. 5B is a side view of the fabric retention member of the portable chair of FIG. 5A according to aspects disclosed herein.
Figure 6:
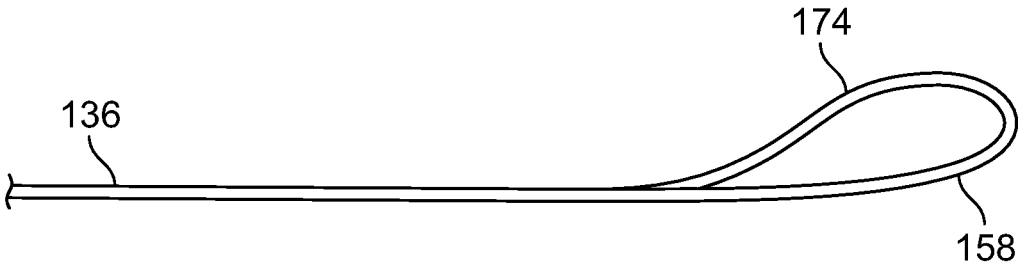
FIG. 6 is an enlarged partial side view of the fabric member of the portable chair of FIG. 1 according to aspects disclosed herein.

As shown in FIGS. 4A, 5A and 5B, each fabric retention member 150 may include a first end 160, a second end 162, a rounded exterior surface 164 extending between the first end 160 and the second end 162, a first interior cavity 166 extending between the first end 160 and the second end 162, and a second interior cavity 168 adjacent the first interior cavity 166 and extending between the first end 160 and the second end 162. Each of the first interior cavity 166 and the second interior cavity 168 may be curved forming a partial cylindrical shape that creates an opening 170, 172 respectively into each interior cavity 166, 168. The openings 170, 172 may extend the entire length of fabric retention member 150. The fabric members 122, 136 may be secured to the fabric retention members 150 by inserting an end portion 154, 158 of the respective fabric members 122, 136 into the opening 172 of the second interior cavity 168. Each end portion 154, 158 may comprise a loop 174 as shown in FIG. 6. The loop 174 may be secured within the second interior cavity 168 of the fabric retention member 150 by a rod 175 that is inserted through one of the ends 160, 162 and simultaneously through of the loop 174 of the respective fabric member 122, 136. The width of the opening 172 may be less than the diameter of the rod 175, thereby securing the respective fabric member 122, 136 in place. Additionally, the radius of the second interior cavity 168 may be greater than the diameter of the rod 175.

The fabric retention member 150 may be removably coupled to its respective rail of the seat frame 124 and the back frame 138. For example, the first interior cavity 166 of each fabric retention member 150 may engage and partially extend around the forward rail 126, the rear rail 128, the first side seat rail 130, the second side seat rail 132, the top rail 140, the first side back rail 144, and the second side back rail 146. The fabric retention member 150 may then be additionally secured to the respective rails of the seat frames 124, 138 using mechanical fasteners, or other means known to one skilled in the art.

As discussed above, the fabric retention member 150 may have a rounded exterior surface 164, where the exterior rounded surface 164 has a cross-sectional shape that has a constant radius from a central axis. Alternatively, the rounded exterior surface 164 may be defined by a combination of multiple radii or a spline forming a smooth curved surface. The first interior cavity 166 and the second interior cavity 168 may also have partial circular cross-sectional shapes where the first interior cavity 166 has a radius, R1, may be substantially the same as the radius of the rails of the seat frame 124 and back frame 138. Additionally, the radius, R1, of the first interior cavity 166 may be larger than the radius, R2, of the second interior cavity 168. Additionally, since the first interior cavity 166 has only a partial circular cross-section, the first interior cavity 166 may extend approximately 180 degrees around from a first opening edge 167 along the surface of first interior cavity 166 to a second opening edge 169, or the first interior cavity 166 may extend within a range of 120 degrees and 240 degrees. In addition, the second interior cavity 168 may extend approximately 300 degrees around from an inboard opening edge 171 along the surface of the second interior cavity to an outboard opening edge 173 or the second interior cavity 168 may extend within a range of 285 degrees and 330 degrees. Also, the fabric retention member 150 may have a substantially constant cross-sectional shape along the length.

As shown in FIGS. 4A and 5B, the opening 170 of the first interior cavity 166 may be positioned at an angle relative to the opening 172 of the second interior cavity 168, where the angle 176 is defined in the cross-section (or side view) of the fabric retention member 150 by a first line segment extending from the center of the first interior cavity 166 to a midpoint of the opening 170 and a second line segment extends from the center of the second interior cavity 168 through a center of the opening 172. The angle 176 may be acute angle of approximately 45 degrees, or within a range of 15 to 75 degrees, or within a range of 10 to 80 degrees. As another option, the angle 176 may be an angle with a range of approximately 15 degrees to 150 degrees.

The fabric retention member 150 may further include a rounded outboard edge 178 of the opening 172 where the outboard edge 178 may be defined by a radius, R3, where R3 is at least 2 times the thickness of the fabric member 136 (122), or in some embodiments at least 4 times the thickness of fabric member 136 (122), or in some embodiments at least 10 times the thickness of fabric member 136 (122). As an end portion 158 (154) of the fabric member 136 (122) exits the opening 172, the fabric member 136 (122) wraps around the rounded outboard edge 178 and then continues to wrap around the rounded exterior surface 164 before the fabric member 136 (122) extends across an unsupported region between the rails of the back frame 138 (or seat frame 124). The fabric member 136 (122) may wrap around at least 60 percent of the length of the rounded exterior surface 164 before extending into an unsupported region, or the fabric member 136 (122) may wrap around the entire exterior rounded surface 164. As another option, the amount the fabric member 136 (122) wraps around the exterior surface 164 of the fabric retention member 150 before being unsupported may be defined by angle 177. The angle 177 is defined by a first line segment extending from the center of the first interior cavity 166 to the second opening edge 169 and a second line segment extending from the center of the first interior cavity 166 to the rounded outboard edge 178 of the opening 172 where the second line segment is tangent to the outboard edge 178. The angle 177 may be approximately 160 degrees, or within a range of 120 degrees and 200 degrees. By wrapping the fabric member 136 (122), around the rounded outboard edge 178 and/or the rounded exterior surface 164 of the fabric retention member 150 helps to relieve the stress on the fabric member 136 (122) at the opening 172. By relieving the stress on the fabric member 136 (122) at the exit of the opening 172 of the fabric retention member 150, the durability and life of the fabric member 136 (122) may be greatly increased.

Figure 4B:
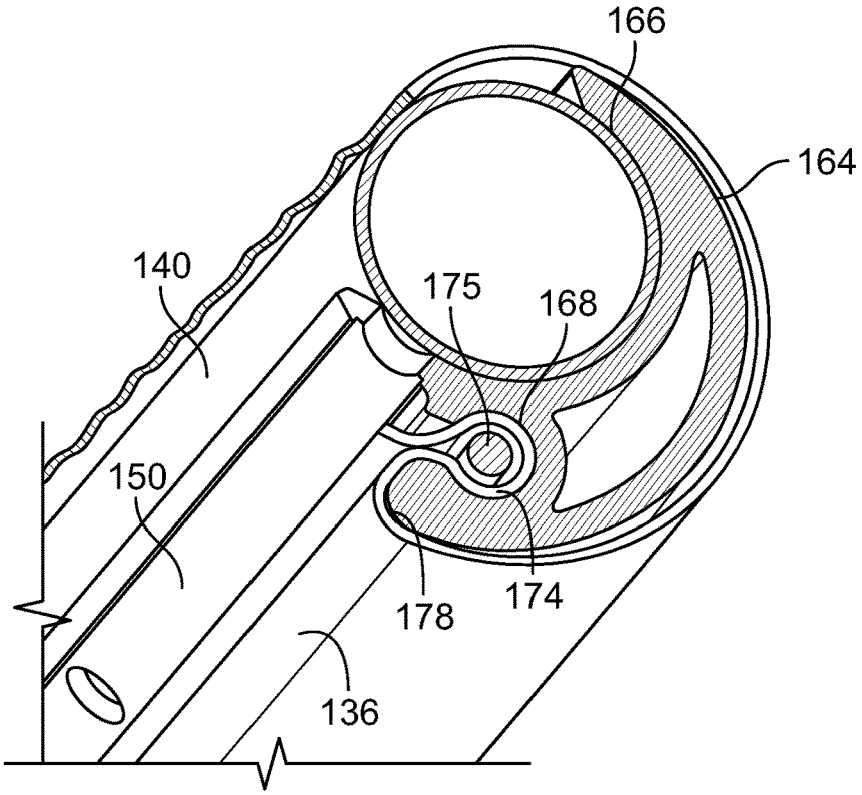
FIG. 4B is an alternate enlarged partial cross-sectional perspective view of the portable chair of FIG. 1 according to aspects disclosed herein.

In an alternate embodiment shown in FIG. 4B, the second interior cavity 168 of the fabric retention member 150 may be located where the center of the second interior cavity 168 is approximately 180 degrees from the second opening edge 169 of the first interior cavity 166. Similar to the embodiment described above, the amount the fabric member wraps around the exterior surface 164 of the fabric retention member 150 before extending into an unsupported region may be defined by angle 177. In this alternate embodiment, the angle 177 may be approximately 180 degrees, or within a range of 140 degrees and 230 degrees. By wrapping the fabric member 136 (122), around the rounded outboard edge 178 and/or the rounded exterior surface 164 of the fabric retention member 150 helps to relieve the stress on the fabric member 136 (122) at the opening 172. By relieving the stress on the fabric member 136 (122) at the exit of the opening 172 of the fabric retention member 150, the durability and life of the fabric member 136 (122) may be greatly increased.

The fabric retention member 150 may be formed from a metallic material, such as aluminum, titanium, stainless steel, scandium, metal alloys, or a non-metallic material such as a polymer or composite material. Because the fabric retention member 150 may have a constant cross-sectional profile throughout its length, it may be formed by an extrusion process if it is metallic or non-metallic. Alternatively, the fabric retention member 150 is formed from a metallic material, the retention member 150 may be formed by a forging, casting, machining, or other near net shape forming process. If the fabric retention member 150 is formed from a non-metallic material, it may be formed using an injection molding process, resin transfer molding, machining, or other molding process.

The fabric members 122, 136 may be a weave-type and/or mesh-like fabric. Additionally, the fabric members 122, 136 may be composed of any of a number of materials including, but not limited to, armored fabric cloth, sail fabric, awning fabric, Kevlar, tarp canvas, vinyl coated polyester, nylon mesh, neoprene, aluminized nylon, and/or cotton canvas. In some embodiments, the material may be treated to provide increased UV stabilization and weathering resistance, fire resistance, abrasion and tear resistance, and waterproofing. In some instances, the fabric members 122, 136 may be composed of a similar materials such that the fabric member 122 of the seat assembly 120 is the same as the fabric member 136 of the back assembly 134. However, in some cases, the fabric member 122 of the seat assembly 120 may be a different material than fabric member 136 of the back assembly 134. For example, fabric member 122 may be made of a first material and/or combination of materials, and fabric member 136 may be made of a second material and/or combination of materials different than the first material and/or combination of materials.

In addition, the portable chair 100 may be arranged in multiple seating positions from an upright position to multiple reclined positions. As shown in FIGS. 7-10, the portable chair 100 may be adjusted from an upright position shown in FIG. 9 to the reclined position illustrated in FIG. 10. In the upright position, the seat assembly 120 and the back assembly 134 may form an angle of approximately 99 degrees, while in the fully reclined position the seat assembly 120 and the back assembly 134 may form an angle of approximately 138 degrees. Accordingly, the chair 100 may have angular difference of approximately 39 degrees between the upright position and the fully reclined position.

Figure 9:
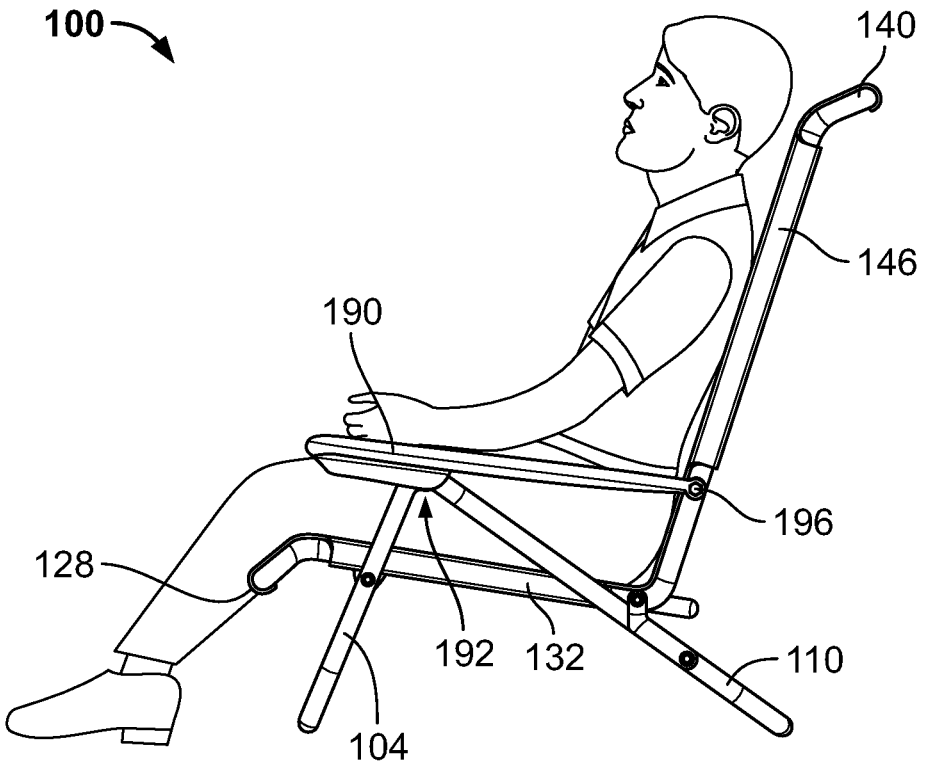
FIG. 9 is a side view of the portable chair of FIG. 1 in an upright position according to aspects disclosed herein.
Figure 10:
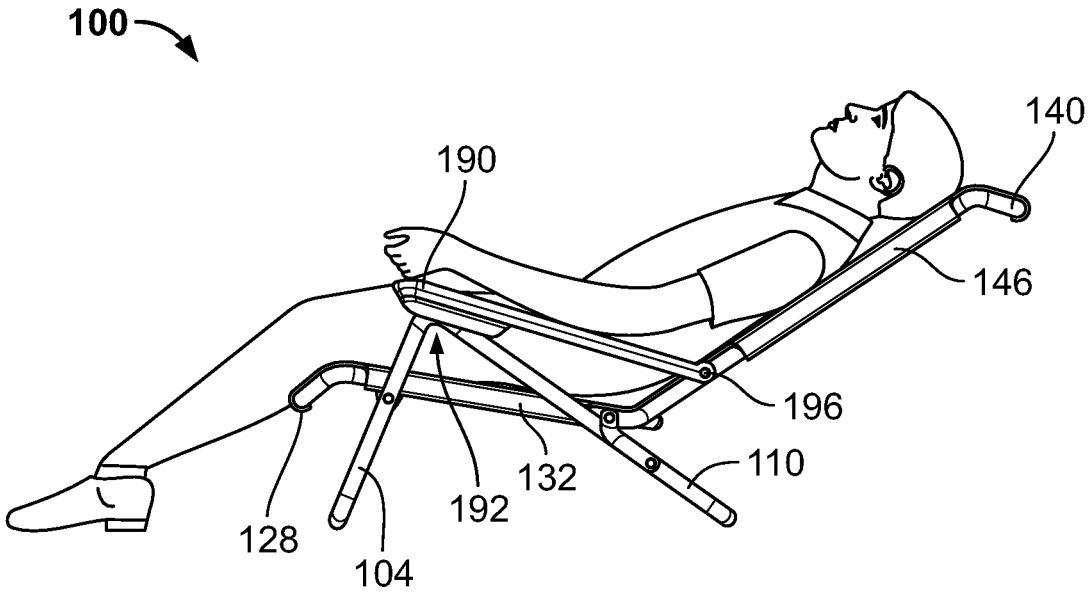
FIG. 10 is a side view of the portable chair of FIG. 1 in a reclined position according to aspects disclosed herein.

The adjustment of the portable chair 100 may be controlled by the relative position of the sliding pivots 186, 192 that are connected to the front legs 102, 104 and the back legs 108, 110. As discussed above, the front legs 102, 104 and back legs 108, 110 may be pivotally attached to the armrests 184, 190 at their respective sliding pivots 186, 192. Each of the sliding pivots 186, 192 may be slidably engaged with its respective armrest 184, 190. As the sliding pivots 186, 192 move along their respective armrests 184, 190, the back assembly 134 of the chair 100 may adjust from an upright position to a reclined position. For example, as illustrated in FIG. 9, when the sliding pivot 186 (192) is slid rearward relative to the armrest 184 (190), the distance from the sliding pivot 186 (192) to the rear end 187 (196) of the armrest 184 is decreased causing the back assembly 134 to move forward and moving the chair 100 into the upright position. Similarly, as illustrated in FIG. 10, when the sliding pivot 186 (192) is slid forward relative to the armrest 184 (190), the distance between the sliding pivot and the rear end 187 (196) is increased causing the back assembly 134 to move forward adjusting the chair 100 into a reclined position.

In order to control the position of the sliding pivots 186, 192, at least one or both of the armrests 184, 190 or may include an armrest body 189, 199 and a control assembly 200 for locking the sliding pivots 186, 192 in a fixed location so that the sliding pivots 186, 192 may only move when actively disengaged by a user to allow the sliding pivots 186, 192 to move relative to the armrest body 189, 199 of the respective armrest 184, 190. As described herein, chair 100 may include one of the different control assembly examples 200 (200A-200E) shown in FIGS. 11-13C, FIGS. 14-15, FIGS. 16-18, FIGS. 19-21, and FIGS. 22-24. In addition, each control assembly 200 may be described with relation to the configuration of the control assembly 200 that works the same on either armrest 184 or 190. It is understood that the control assembly 200 of armrest 184 may be arranged in a mirrored configuration on armrest 190. As described and shown in the examples herein, the control assembly 200 may be described as it is arranged on armrest 184 with the understanding that the control assembly 200 on armrest 190 positioned opposite armrest 184 may be arranged in a similar manner as armrest 184, but in a mirrored configuration about a central plane of the chair 100.

Figure 13A:
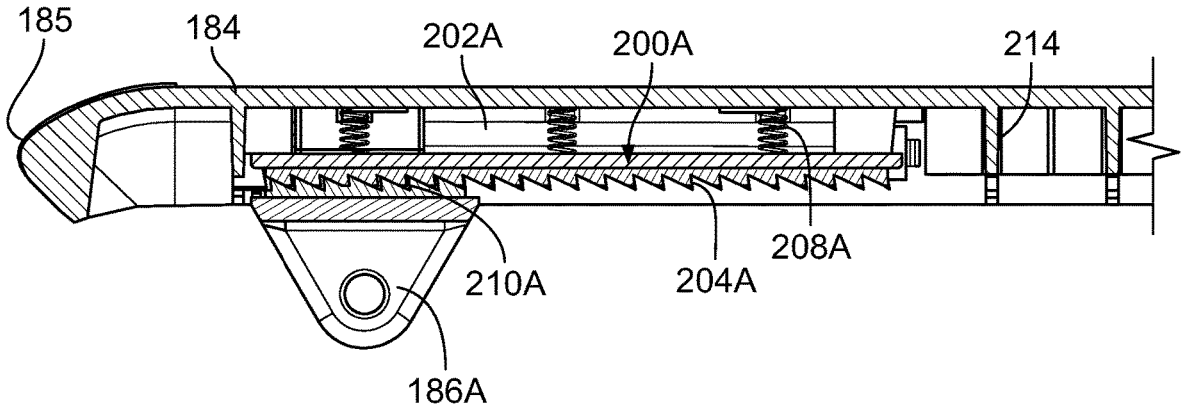
FIG. 13A is a cross-sectional side view of the armrest of FIG. 11 according to aspects disclosed herein.
Figure 13B:
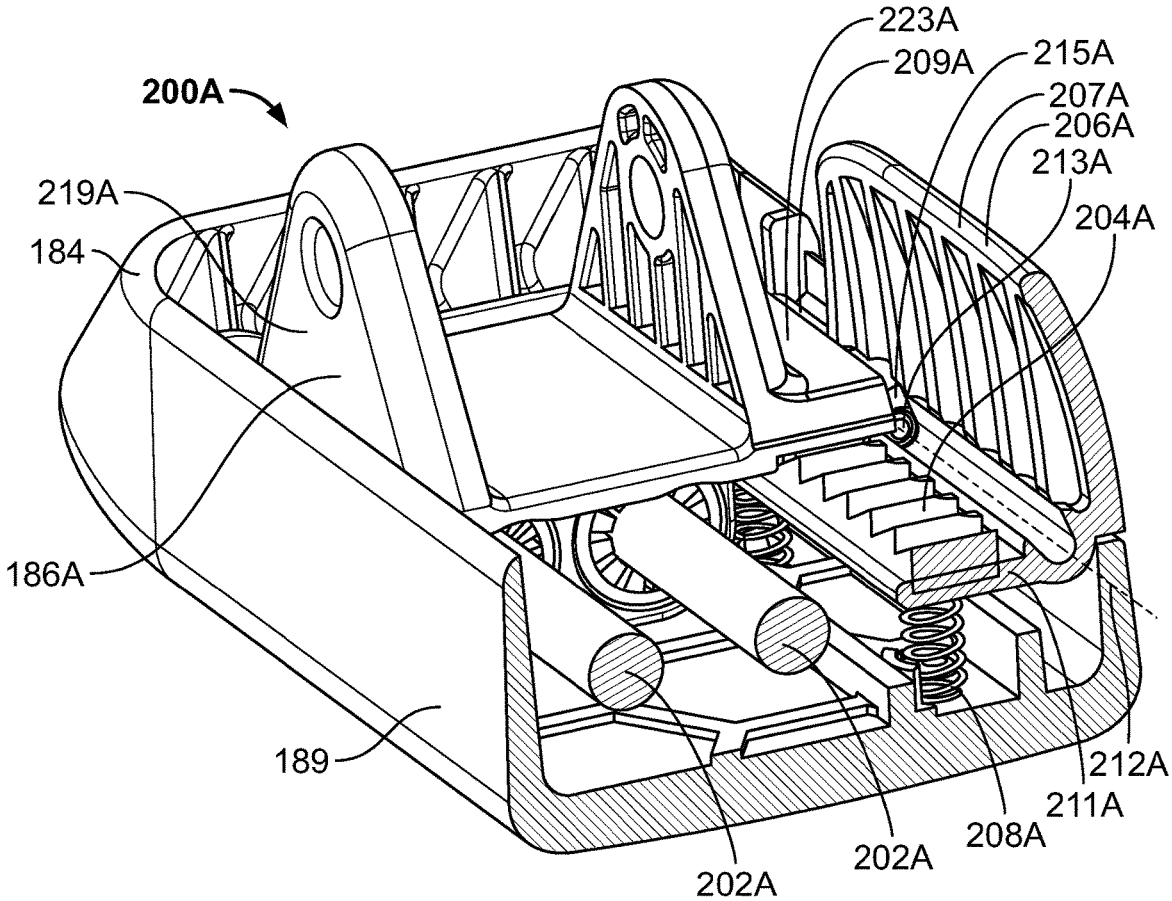
FIG. 13B is a partial cross-sectional perspective view of the armrest of FIG. 11 as disclosed herein.
Figure 13C:
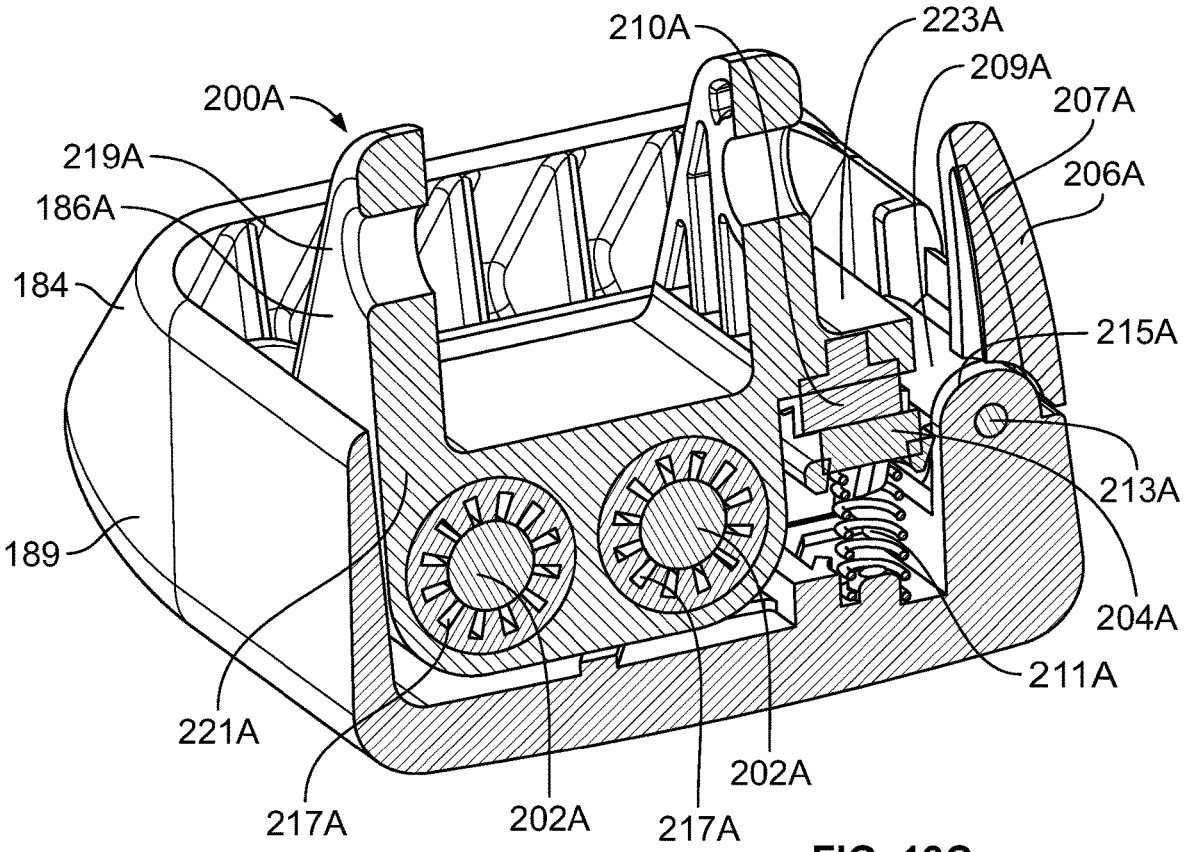
FIG. 13C is a partial cross-sectional perspective view of the armrest of FIG. 11 as disclosed herein.

FIGS. 11-13C illustrate an exemplary embodiment of an armrest 184, 190 with control assembly 200A configured to control the position of the sliding pivots 186, 192. The control assembly 200A may include sliding pivot 186A if the control assembly 200A is on armrest 184 (or sliding pivot 192A if the control assembly 200A is on armrest 190), a guide rail or plurality of guide rails 202A positioned on a bottom side of the armrest body 189, where the sliding pivot 186A is slidably engaged with the guide rails 202A, a set of engaging teeth 204A positioned adjacent the guide rail(s) 202A, a side paddle 206A that includes or is connected to the engaging teeth 204A, and a resilient member 208A (or plurality of resilient members). As shown in FIGS. 13A-C, the sliding pivot 186A may have a set of engaging teeth 210A that engage a set of engaging teeth 204A on the side paddle 206A to keep the sliding pivot 186A locked in place. In addition, the resilient member(s) 208A may apply a force against the engaging teeth 204A to keep them engaged with the engaging teeth 210A located on the sliding pivot 186A. When a user wants to adjust the chair 100 from an upright to fully reclined position, or any position in between, the user applies an inward force on side paddle 206A, which causes the side paddle 206A to rotate upward. As the side paddle's movement overcomes the force applied by the resilient member(s) 208A, the engaging teeth 204A move upward to disengage from the engaging teeth 210A on the sliding pivot 186A. Once the engaging teeth 204A, 210A are disengaged from one another, the sliding pivot 186A may slide freely along the guide rail(s) 202A, thereby adjusting the position or angle of the back assembly 134 relative to the armrest 184. Once the user releases the side paddle 206A, the resilient member(s) 208A again applies the force necessary for the engaging teeth 204A, 210A to contact one another, locking the sliding pivot 186A securely in place.

The sliding pivots 186A, 192A may include a clevis 219A on the lower end with an opening to receive a pin that extends though the clevis 219A and the respective front and back legs 102, 104, 108, 110 to rotatably attach the legs to the respective armrest 184, 190. The sliding pivots 186, 192 may also include a slide member 221A positioned opposite the clevis 219A to engage and at least partially wrap around the guide rail(s) 202A. In some examples, the sliding pivot 186A may include a bushing 217A that engages each guide rail 202 to provide smooth movement of the sliding pivot 186 along the guide rail 202. In addition, the sliding pivots 186A, 192A may also include an engaging portion 223A that supports the engaging teeth 201A. The engaging portion 223A may be located adjacent the clevis 219A, such that the engaging teeth 210A are located outboard of the connection of the front and back legs 102, 104, 108, 110. The guide rail 202A may have a fixed length with stops 225A on each end to prevent the sliding pivots 186, 192 from traveling beyond the length of the guide rail(s) 202A. In some examples, guide rail(s) 202A may be members configured to allow the pivot 186A to slide freely. The guide rails 202A may have a cylindrical shape, rectangular shape, or other geometric shape to allow the pivot 186A to slidably engage the guide rails 202A. In some examples, the guide rails 202A may be integrally formed with the armrest body 189 (199), while in other examples, the guide rails 202A may be formed separately and attached to the armrest. In addition, the overall amount of travel of the sliding pivots 186A, 192A may be expressed as a ratio of the length of the sliding pivot. For instance, the overall travel of the sliding pivots 186A, 192A may be approximately 1.75 times the length of the pivot or within a range of 1.5 and 2.0 times the length of the pivot. The length of the pivot may be defined as a distance from a forward end to a rearward end of the slide member 221A of the sliding pivot 186A, where the length is oriented in a direction from a front to a rear of the armrest 184, 190.

The multiple teeth on each set of engaging teeth 204A, 210A allow the adjustment of multiple reclining positions for the chair 100. The sets of engaging teeth 204A, 210A may be arranged linearly and have coarse arrangement. For example, the teeth may have a frequency of approximately 1.45 teeth per centimeter of length or within a range of 1.3 and 1.7 teeth per centimeter. This coarse arrangement may help the teeth have the adequate strength to support the loads while also providing a variety of reclining positions for a user. In addition, each tooth of engaging teeth 204A may have a chamfered edge 205A on the upper portion of the tooth. Each chamfered edge 205A may be on the side of the tooth nearest the actuation portion 207A of the side paddle 206A (i.e. outboard side of the engaging teeth 204A). In some instances, the engaging teeth 204A on the side paddle 206A may be arranged in an offset configuration with the engaging teeth 210A of the sliding pivot 186A, i.e. the centerline of the two sets of teeth 204A, 210A are spaced apart from each other, while in other instances, the centerline of both sets of engaging teeth 204A, 210A may be aligned with each other. In addition, the length of the engaging teeth 204A on the sliding pivot 186A may be expressed as a relationship of the overall length of the engaging teeth 210A on the armrest 184. For examples, the length of the engaging teeth 204A may be approximately 2.75 times the overall length of the engaging teeth 210A on the armrest 184, or within a range of 2.5 times and 3.0 times the overall length of the engaging teeth 210A on the armrest 184, where the length is oriented in a direction from a front to a rear of the armrest 184, 190.

As shown in FIGS. 13A-13C, the side paddle 206A may be located on an outboard side of armrest 184 or 190 and be used to control the recline angle of the chair 100. The side paddle 206A may include an actuation portion 207A that receives the contact or force from a user, a receiver 209A that defines a rotational axis 212A and receives a pin 213A, and an engaging portion 211A extending from receiver 209A that includes an the engaging teeth 204A. The receiver 209A may be positioned between the actuation portion 207A and the engaging portion 211A. Engaging teeth 204A may be either integrally formed with the side paddle 206A or formed as a separate member and attached to the engaging portion 211A. Actuation portion 207A and engaging portion 211A may be substantially perpendicular to each other or arranged within a range of 60 and 110 degrees to each other. As discussed above, the side paddle 206A may be pivotally connected to the armrest 184 via pin 213A that engages a receiver 209A on the side paddle 206A and a receiver 215A on armrest 184, such that a force applied to the actuation portion 207A of the side paddle 206A causes the actuation portion 207A to move inward and causes the engaging teeth 204A to simultaneously move upward as the side paddle 206A rotates about the hinged attachment axis 212A. Additionally, the actuation portion 207A of the side paddle 206A may have a width that extends downward beyond the bottom of the armrest 184, while the teeth 204A extend generally horizontal such that the actuation portion 207A of the side paddle 2016A is oriented substantially perpendicular to the teeth 204A. This perpendicular configuration may be beneficial to use the width of the actuation portion 207A to act as a lever to help minimize the force needed by the user to overcome the force applied by the resilient member(s) 208A. The resilient member(s) 208A may be a single compression spring or a plurality of evenly spaced compression springs as shown in FIG. 13A.

Figure 11:
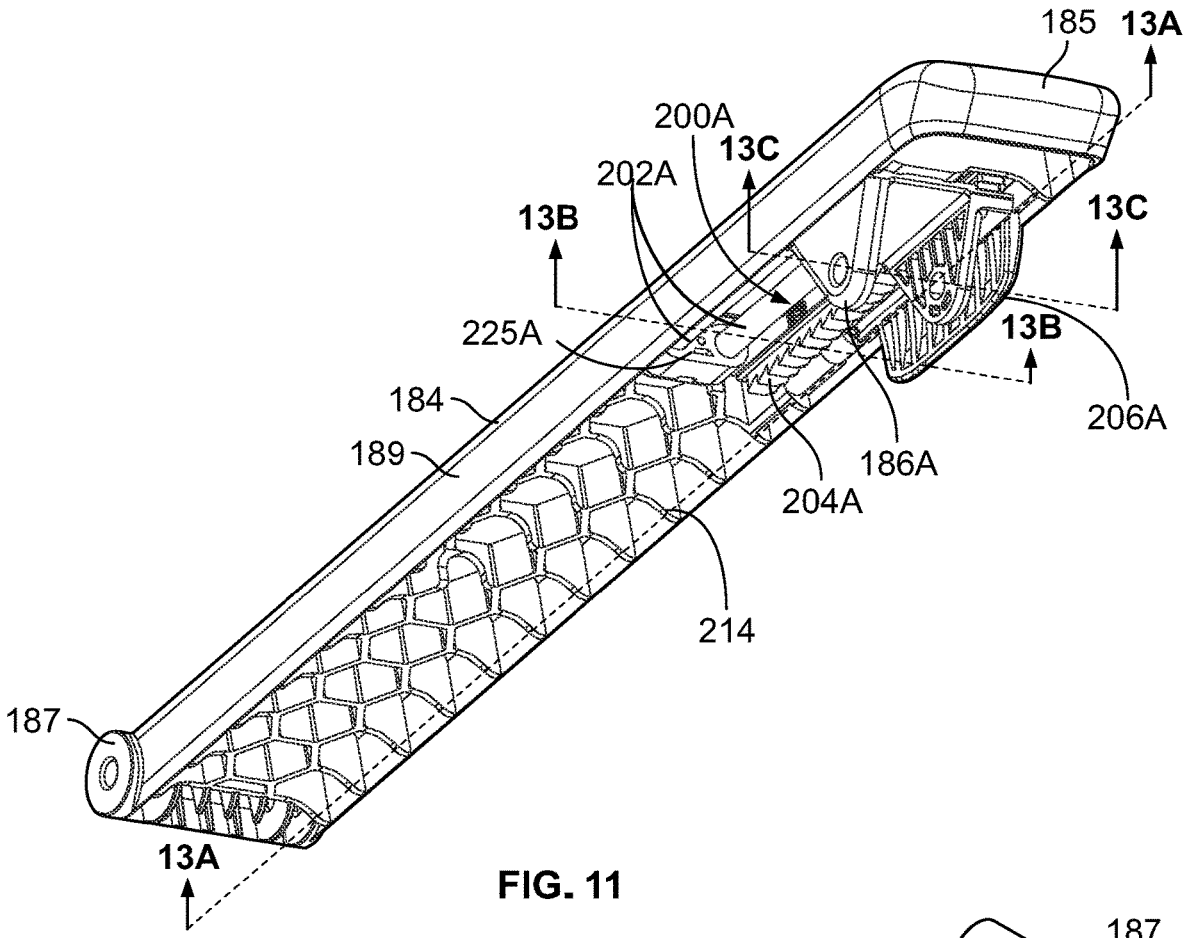
FIG. 11 is a lower front perspective view of the armrest of the portable chair of FIG. 1 according to aspects disclosed herein.
Figure 12:
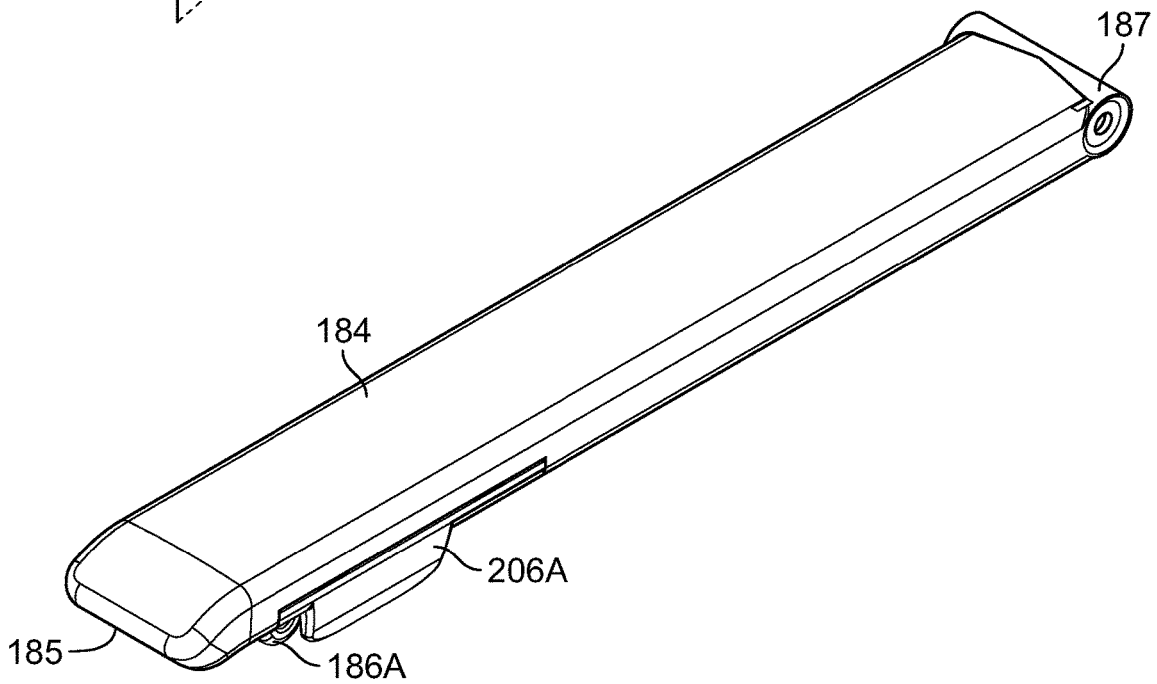
FIG. 12 is a top front perspective view of the armrest of the portable chair of FIG. 11 according to aspects disclosed herein.

As another feature, the armrest body 189 may have a substantially smooth top surface with a plurality of ribs 214 arranged on the bottom side of the armrest 184. The ribs 214 may be arranged in a honeycomb pattern as shown in FIG. 11 and be positioned aft of the teeth 204A and extend to the rear end 187 of the armrest 184. The ribs 214 may help to increase the stiffness of the armrest 184, while helping to minimize its weight. In some examples, the ribs 214 may extend an entire length of the armrest. For example, the ribs 214 may have varying height such that the forward ribs 214A may be beneath the guide rails 202A.

Figure 14:
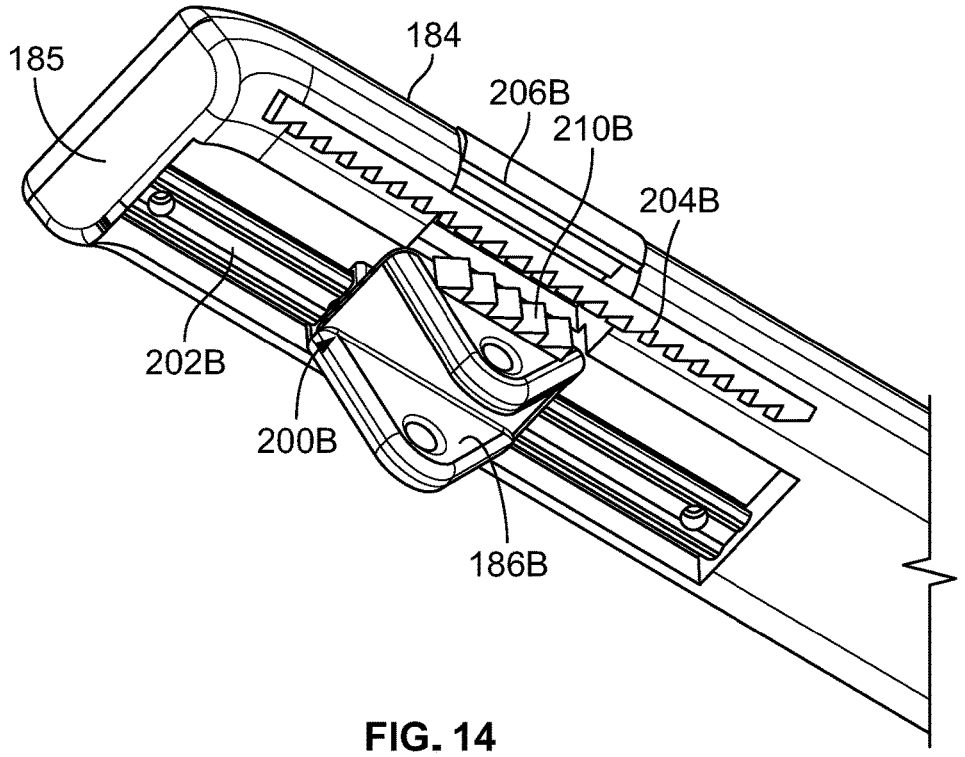
FIG. 14 is a lower front perspective view of an alternate embodiment of the armrest of the portable chair of FIG. 1 according to aspects disclosed herein.
Figure 15:
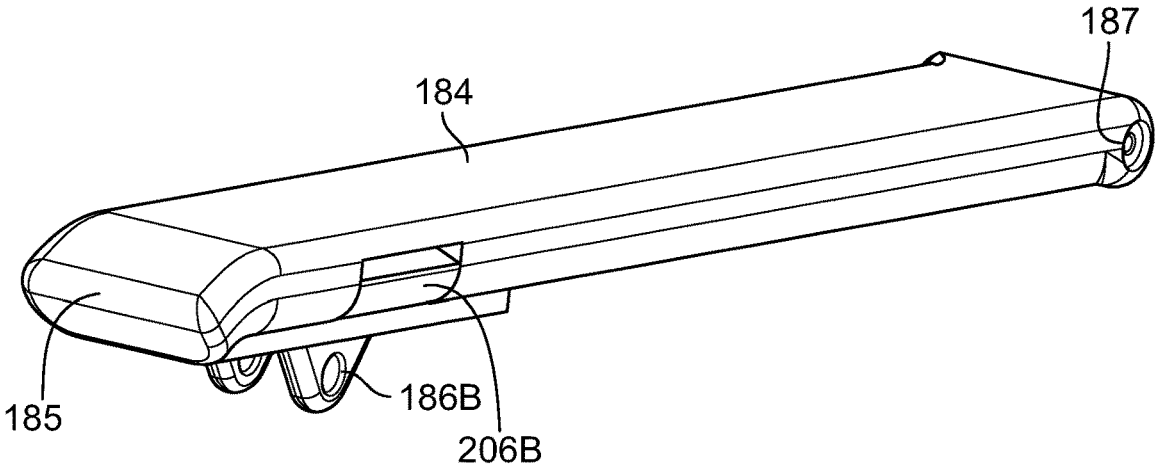
FIG. 15 is a top front perspective view of the armrest of FIG. 14 according to aspects disclosed herein.

FIGS. 14 and 15 illustrate alternate control assembly 200B. The operation of control assembly 200B is generally similar to control assembly 200A illustrated in FIGS. 11-13C, however, the engaging teeth 210B on the sliding pivot 186B are positioned along the side of the sliding pivot 186B such that a user may lift the handle 206B upward to disengage the engaging teeth 204B from the engaging teeth 210B, which allows the sliding pivot 186B to move freely along the guide rail 202B. The resilient member 208B may be a torsion spring to apply a force to keep the engaging teeth 210B engaged with the teeth 204B of the sliding pivot 186B.

Figure 16:
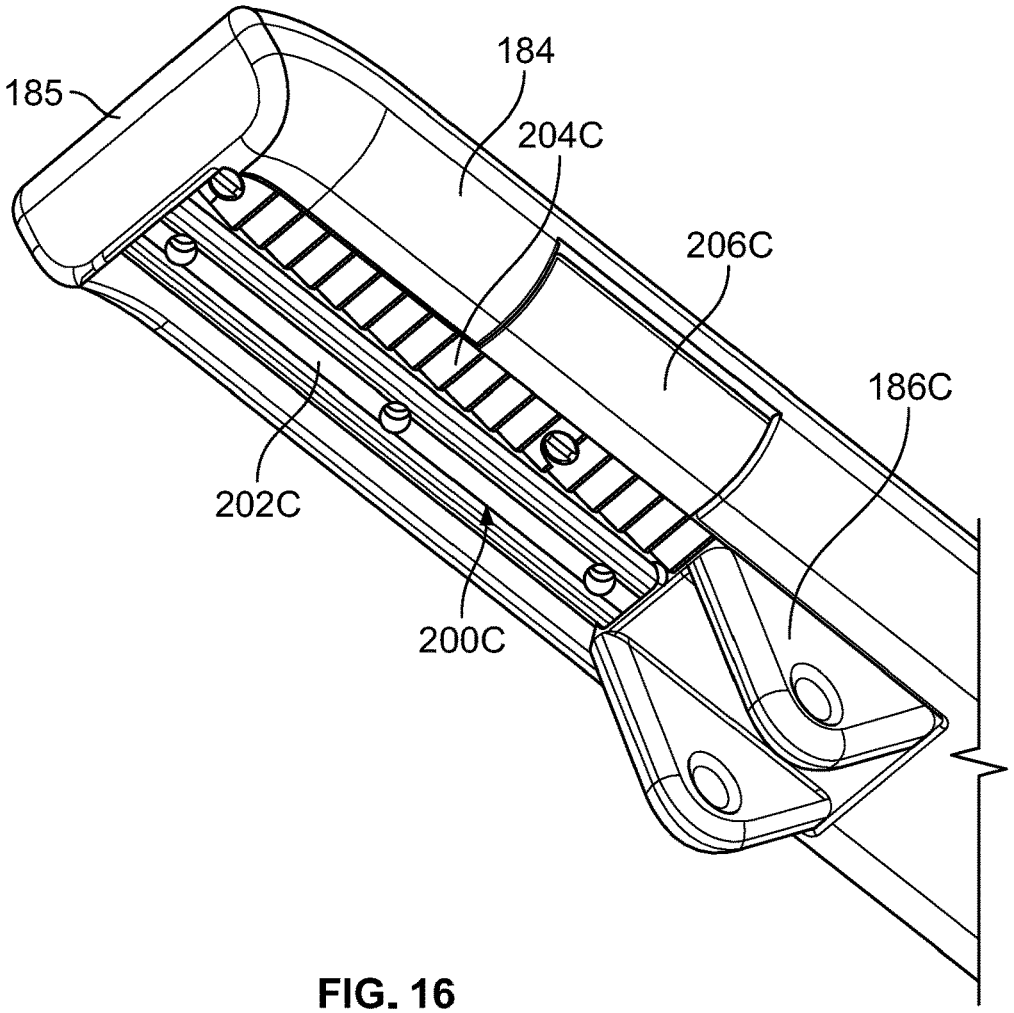
FIG. 16 is a lower front perspective view of an alternate embodiment of the armrest of the portable chair of FIG. 1 according to aspects disclosed herein.
Figure 17:
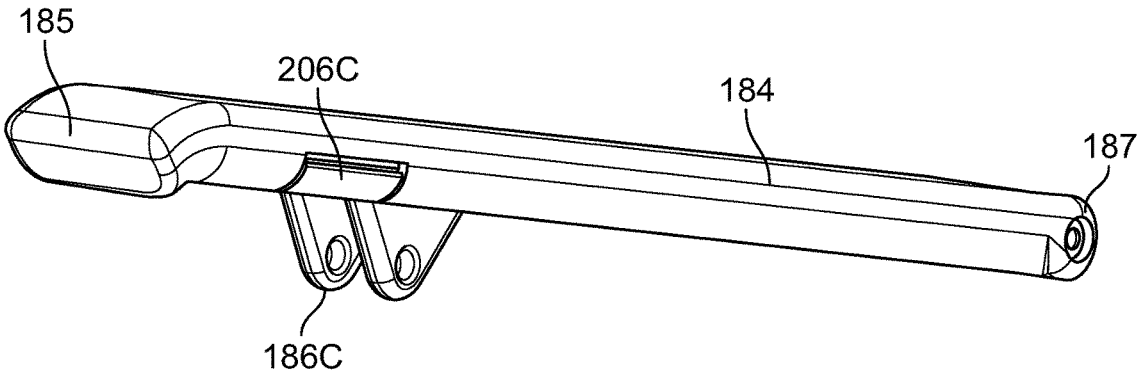
FIG. 17 is a side perspective view of the armrest of FIG. 16 according to aspects disclosed herein.
Figure 18:
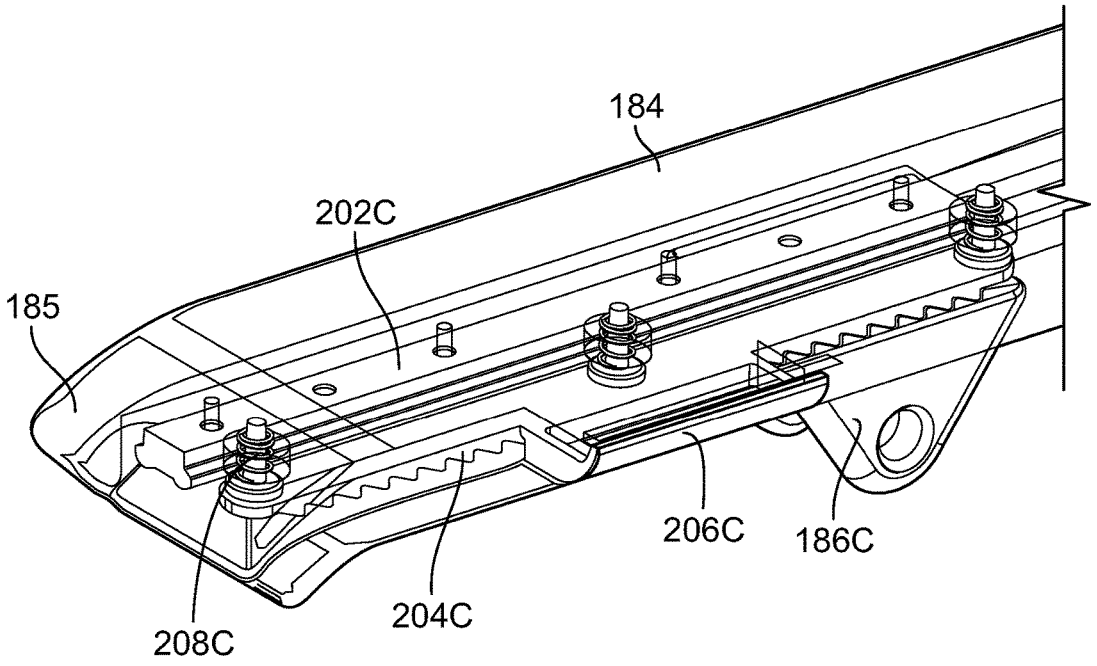
FIG. 18 is a top front perspective view of the armrest of FIG. 16 with the inner geometry shown according to aspects disclosed herein.

FIGS. 16-18 illustrate alternate control assembly 200C. The operation of control assembly 200C is generally similar to control assembly 200A illustrated in FIGS. 11-13C, however, the button 206C is moved upward to disengage the engaging teeth 204C from the teeth 210C located on the top of the sliding pivot 186C. Once the teeth 210C are disengaged from the engaging teeth 204C, the sliding pivot 186C may move freely along the guide rail 202C. The resilient member 208C may be a compression spring (or plurality of compression springs) oriented to apply a force to keep the engaging teeth 210C engaged with the teeth 204C of the sliding pivot 186C.

Figure 19:
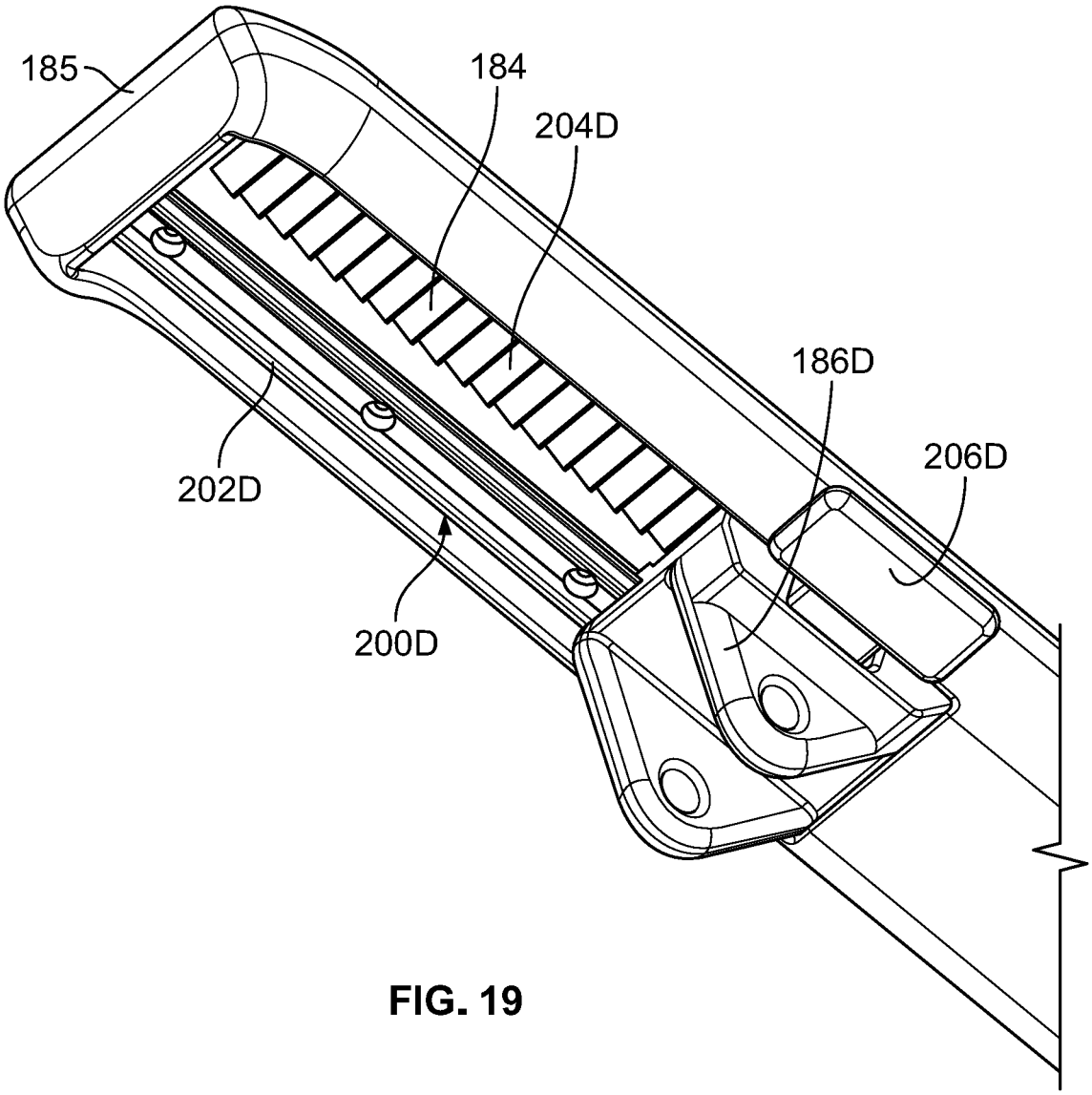
FIG. 19 is a lower front perspective view of an alternate embodiment of the armrest of the portable chair of FIG. 1 according to aspects disclosed herein.
Figure 20:
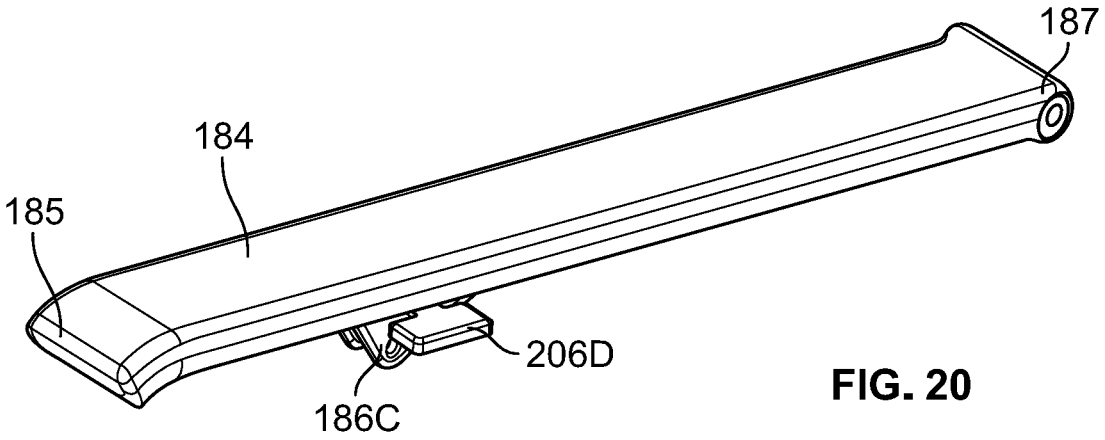
FIG. 20 is a top front perspective view of the armrest of FIG. 19 according to aspects disclosed herein.
Figure 21:
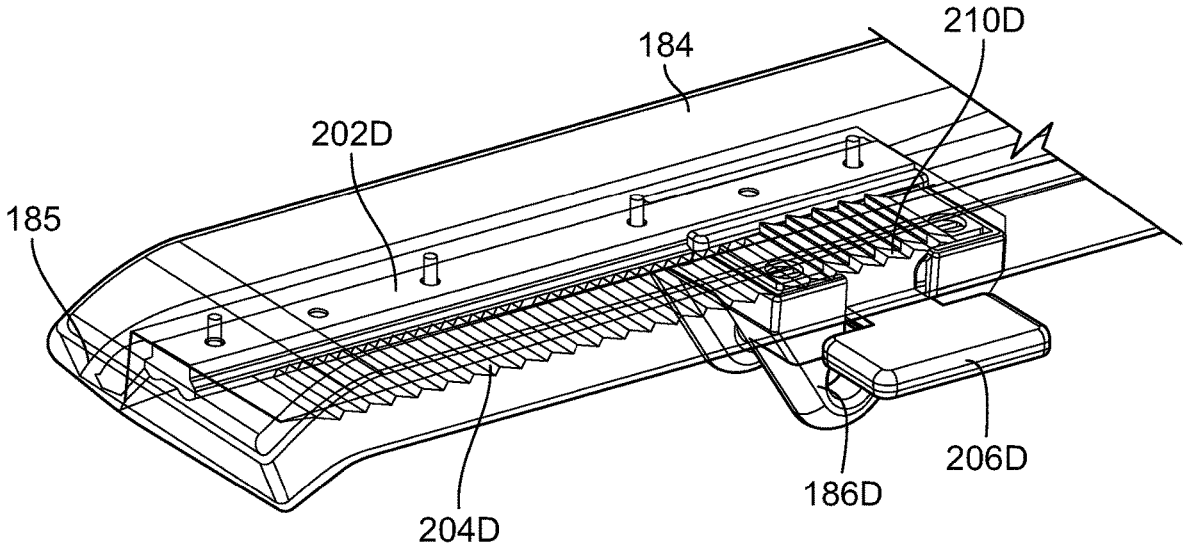
FIG. 21 is a top front perspective view of the armrest of FIG. 20 with the inner geometry shown according to aspects disclosed herein.

FIGS. 19-21 illustrate alternate control assembly 200D. The operation of control assembly 200C is generally similar to control assembly 200A illustrated in FIGS. 11-13C, except in control assembly 200D, sliding pivot 186D has engaging teeth 210D secured within a pocket on top of the sliding pivot 186. The engaging teeth 210D may be free to move vertically within the pocket to engage and disengage the teeth 210D from the teeth 204D on the armrest 184. A resilient member 208D may be placed within the pocket on the sliding pivot 186D to apply the necessary force to keep the teeth 210D engaged to the teeth 204D of the armrest. The handle 206D may be directly attached or unitarily formed with the engaging teeth 210D, such that when a user pushes downward on the handle, the engaging teeth 210D move vertically away from the teeth 204D to disengage the teeth 210D and allow the pivot 186D to slide freely along the guide rail 202D.

Figure 22:
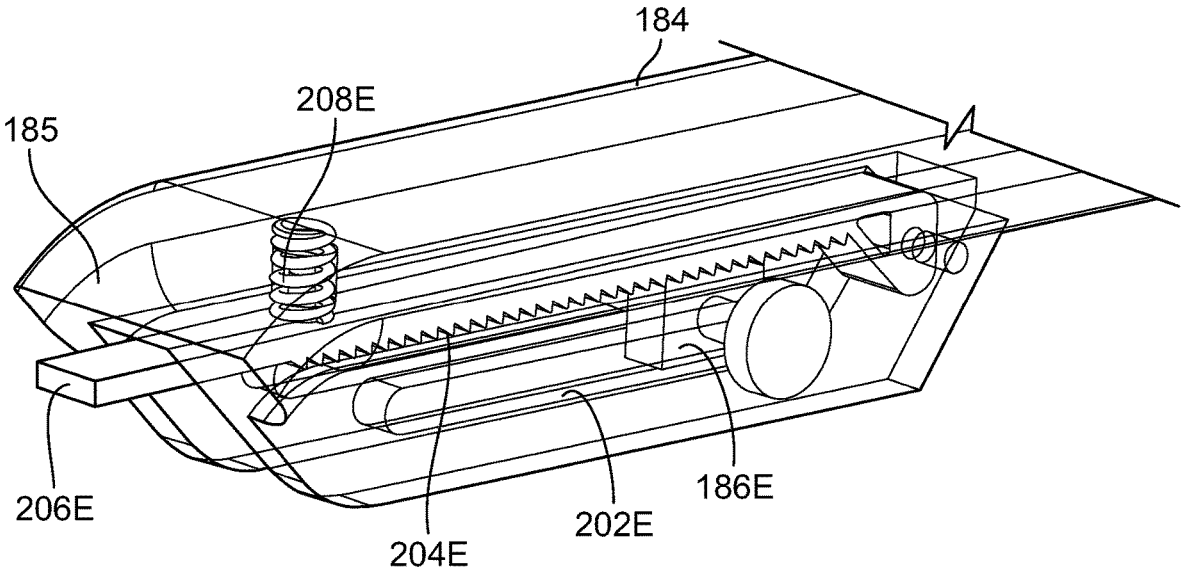
FIG. 22 is a top front perspective view of an alternate embodiment of the armrest of the portable chair of FIG. 1 with the inner geometry shown according to aspects disclosed herein.
Figure 23:
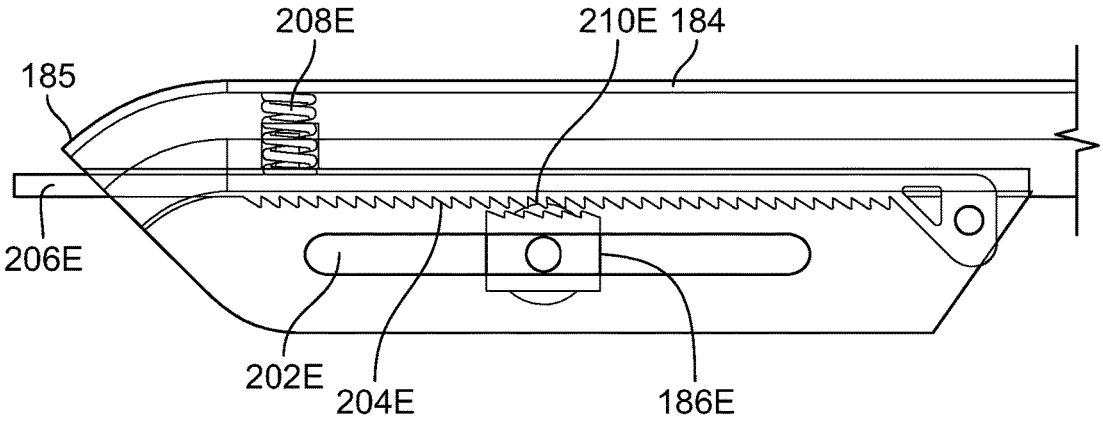
FIG. 23 is a side view of the armrest of FIG. 22 in a locked position with the inner geometry shown according to aspects disclosed herein.
Figure 24:
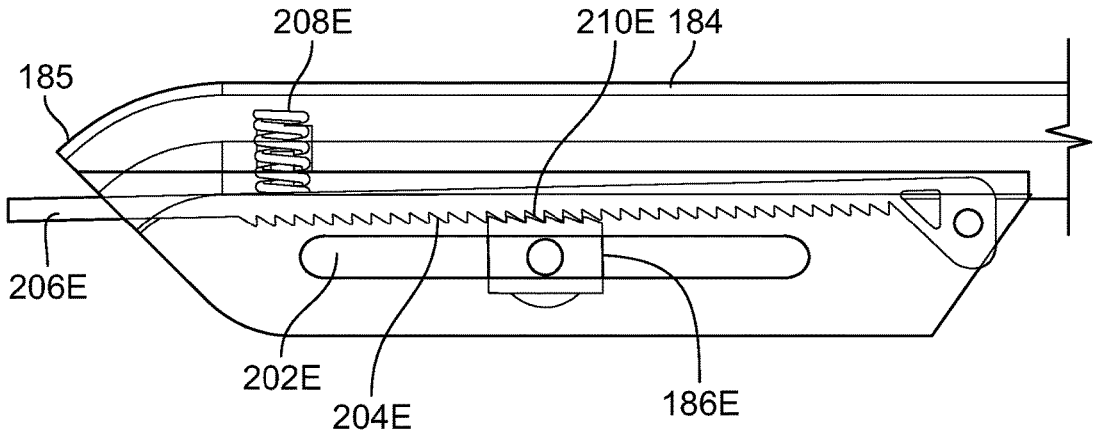
FIG. 24 is a side view of the armrest of FIG. 22 in a unlocked position with the inner geometry shown according to aspects disclosed herein.

FIGS. 22-24 illustrate alternate control assembly 200E. Control assembly 200E may include engaging teeth 204E pivotally arranged on a lever handle 206E extending from a forward end of the armrest 184. The sliding pivot 186E may have engaging teeth 210E on top of the pivot 186E to engage the engaging teeth 204E on the armrest 184. A resilient member 208E, which may be a compression spring, applies a vertical force to the engaging teeth 204 to keep them engaged with the teeth 210E. To disengage the teeth, a user may pull upwards on the lever 206E, then the sliding pivot 186E may be free to slide along the guide slot 202E located in the inner surface of the armrest 184. Once the lever is released by the user, the resilient member 208E applies the necessary force to engage the teeth 204E, 210E to lock the pivot 186E in place. Thereby securing the chair 100 in the desired position.

Figure 25:
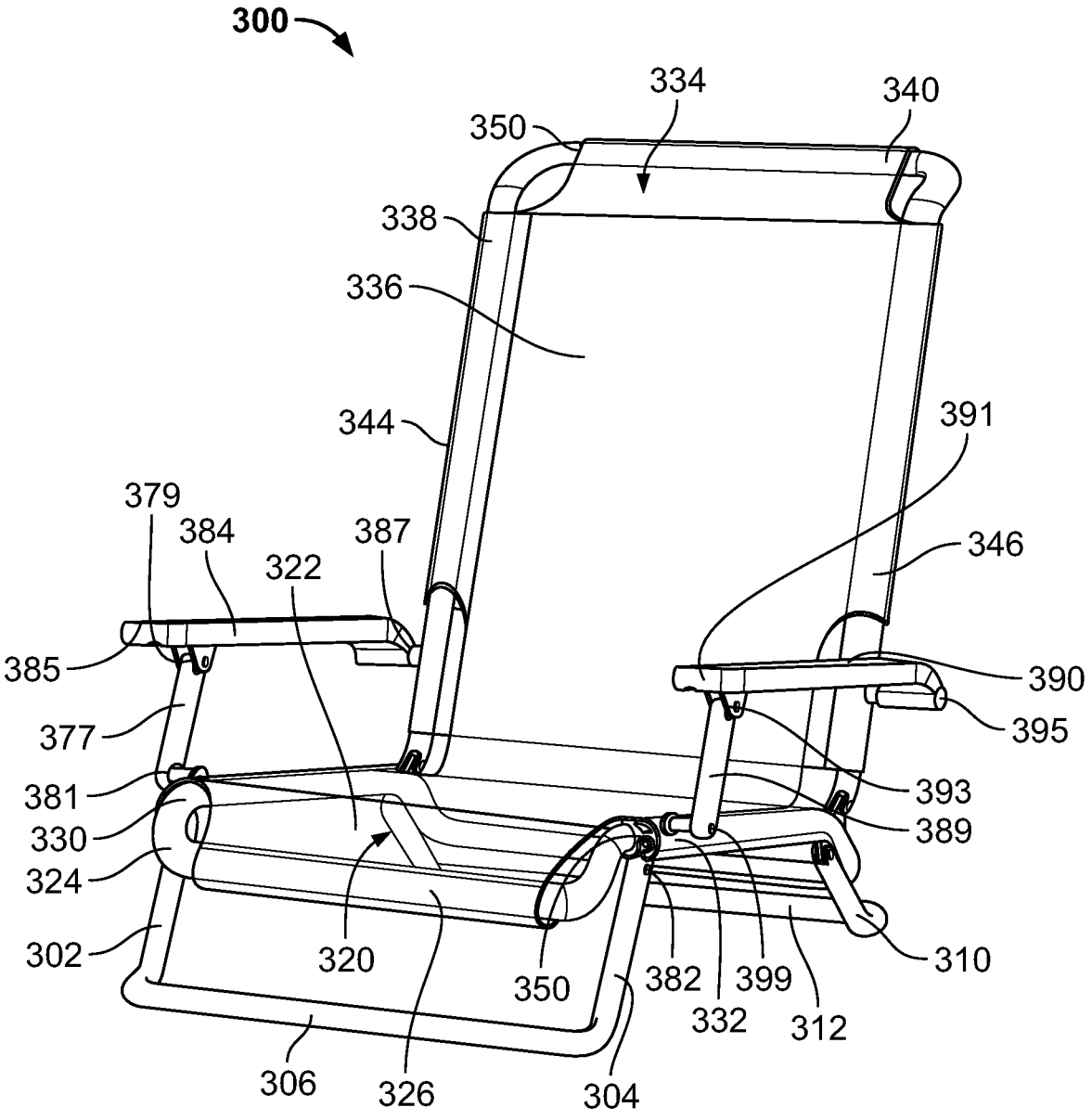
FIG. 25 is a top front perspective view of an alternate embodiment of the portable chair of FIG. 1 according to aspects disclosed herein.
Figure 26:
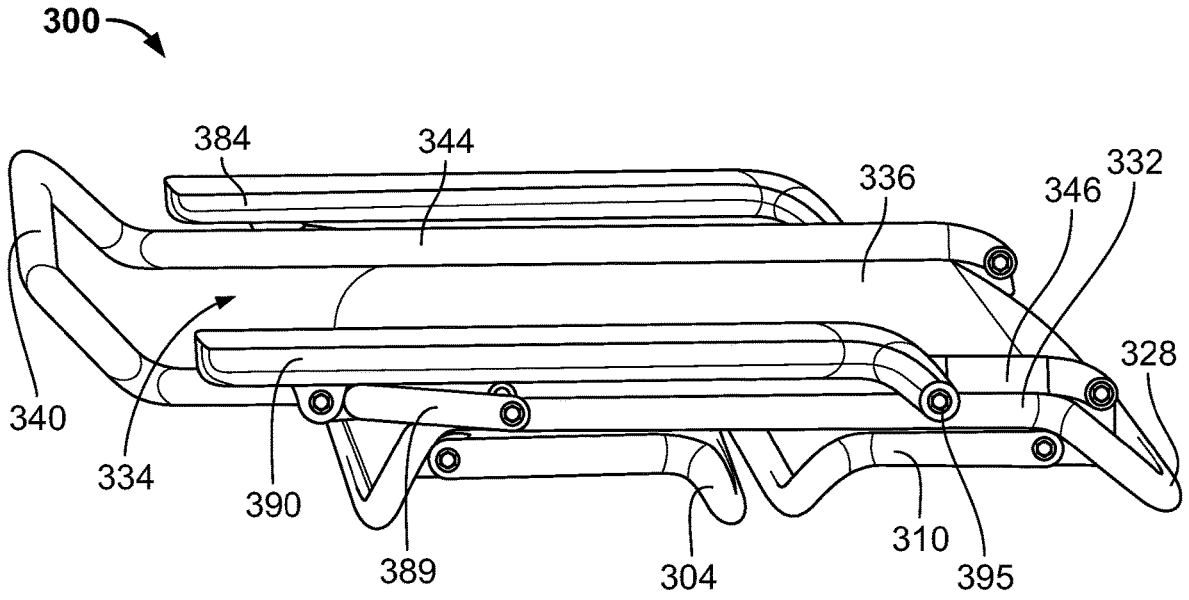
FIG. 26 is a top front perspective view of the portable chair of FIG. 25 in a folded position according to aspects disclosed herein.
Figure 27:
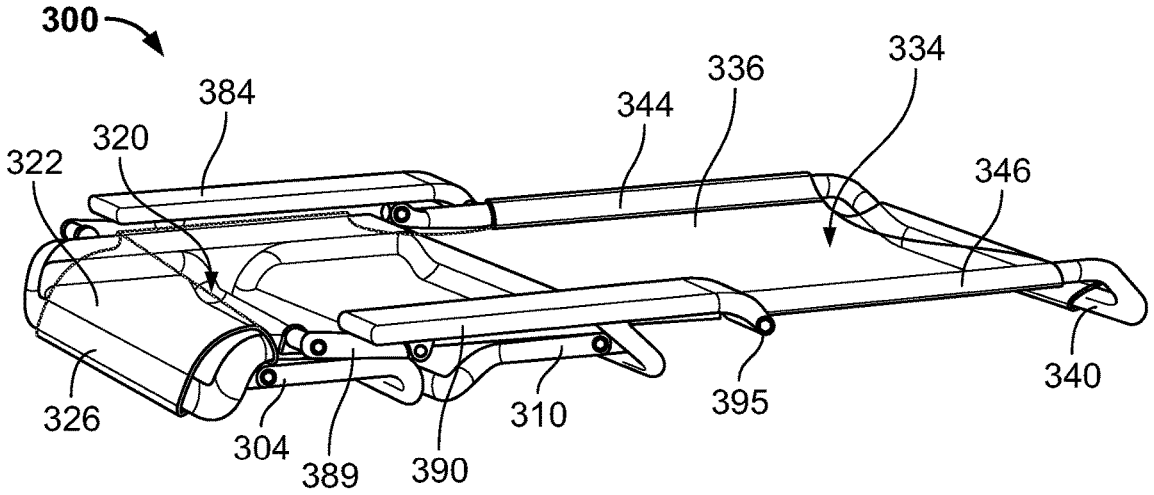
FIG. 27 is a top front perspective view of the portable chair of FIG. 25 in a reclined position according to aspects disclosed herein.
Figure 28:
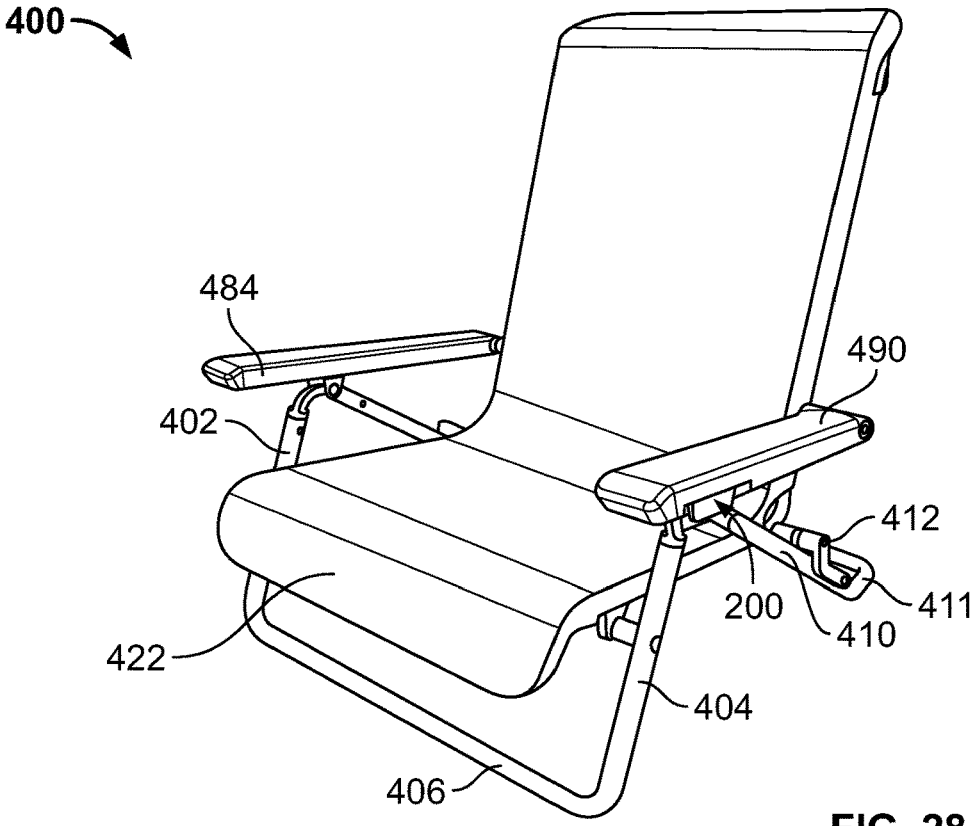
FIG. 28 is a top front perspective view of an alternate embodiment of the portable chair in an upright position of FIG. 1 according to aspects disclosed herein.
Figure 29:
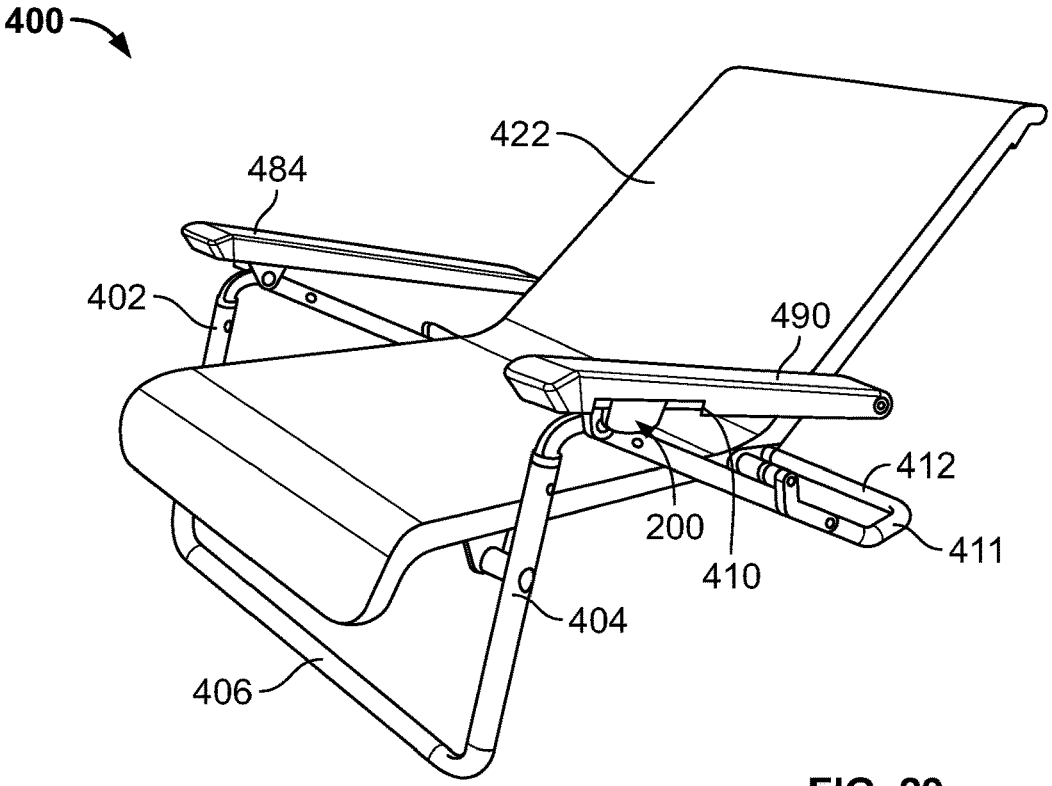
FIG. 29 is a top front perspective view of the portable chair of FIG. 28 in a reclined position according to aspects disclosed herein.
Figure 30:
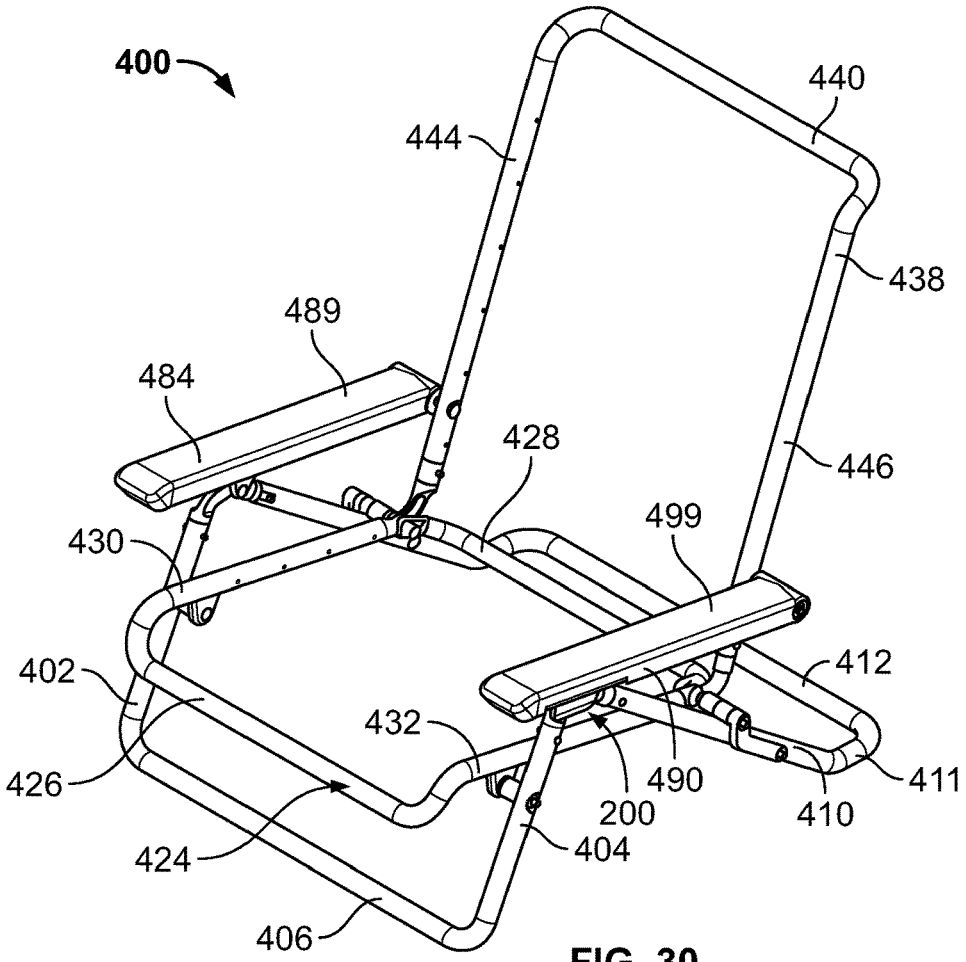
FIG. 30 is a top front perspective view of the portable chair of FIG. 28 in an upright position with the fabric member removed for clarity according to aspects disclosed herein.
Figure 31:
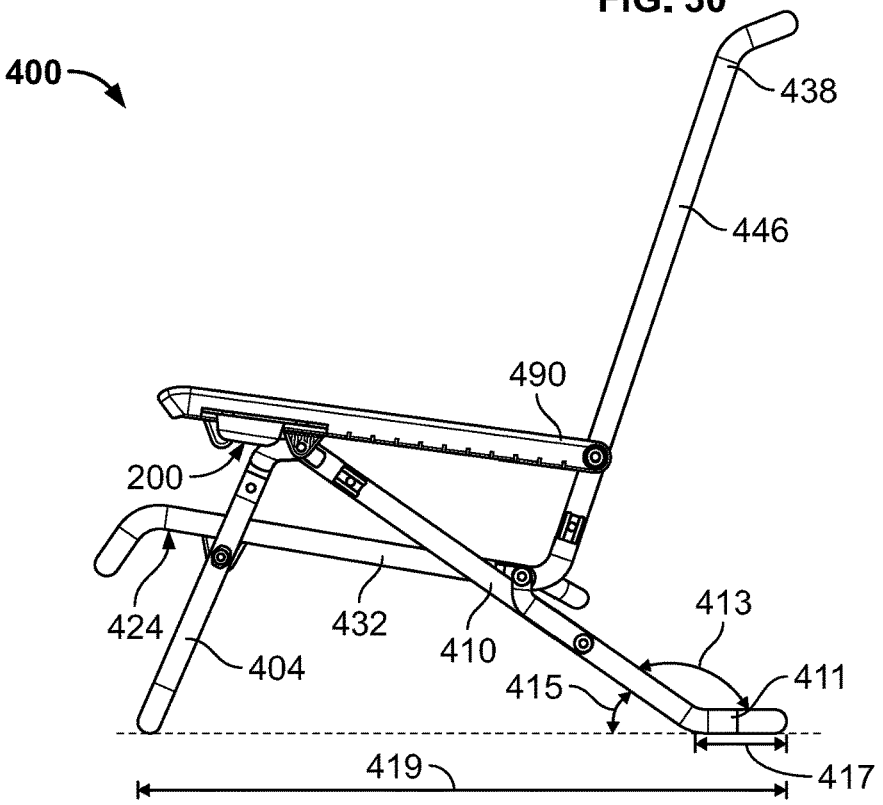
FIG. 31 is a side view of the portable chair of FIG. 28 in an upright position with the fabric member removed for clarity according to aspects disclosed herein.
Figure 32:
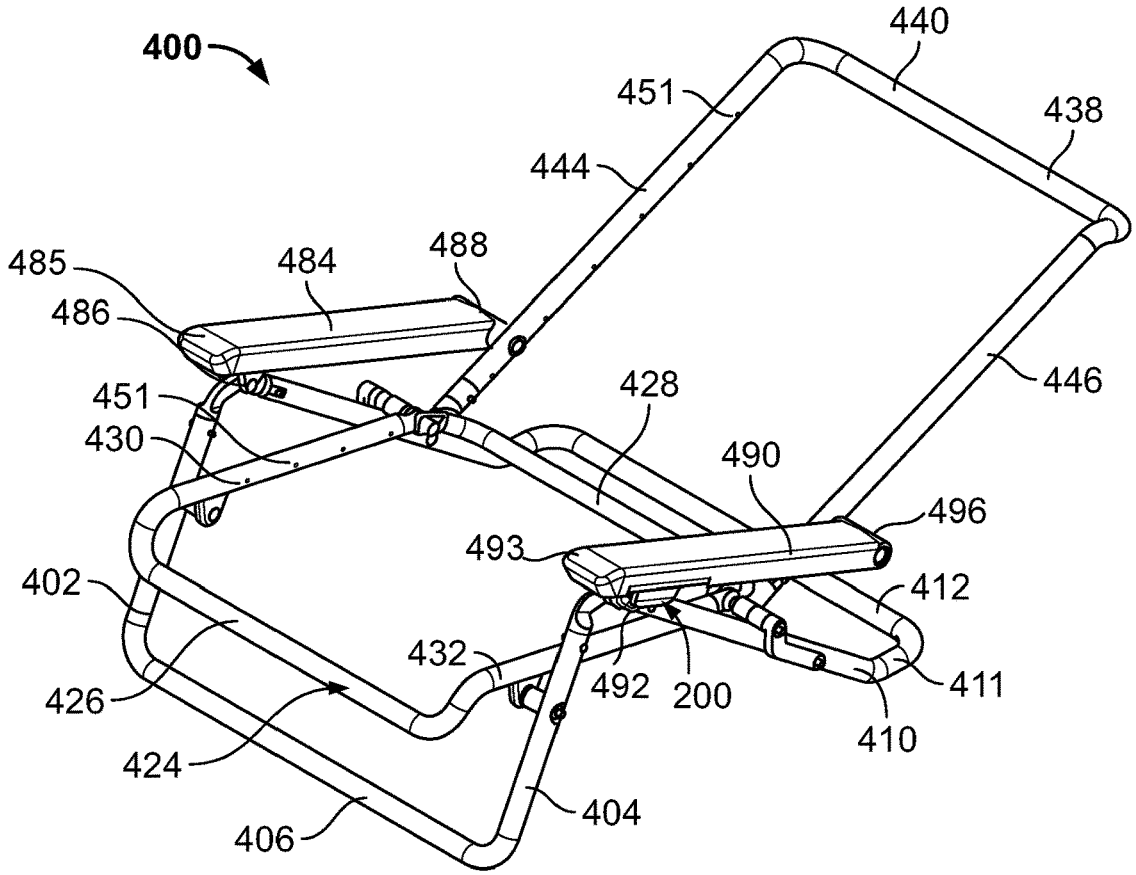
FIG. 32 is a top front perspective view of the portable chair of FIG. 28 in a reclined position with the fabric member removed.

For the embodiment illustrated in FIGS. 25-27, the features are referred to using similar reference numerals under the "3xx" series of reference numerals, rather than "1xx" as used in the embodiments of FIGS. 1-10. Accordingly, certain features of the chair 300 that were already described above with respect to chair 100 of FIG. 110 may be described in lesser detail, or may not be described at all. FIGS. 25-27 illustrate alternate chair 300. Chair 300 comprises a different leg configuration than chair 100 that allows chair 300 to recline into a substantially flat position. In other words, the seat assembly 320 and the back assembly 334 may be substantially coplanar as shown in FIG. 27 when in a fully reclined position. Chair 300 may have fabric retention members 350 and fabric members 322, 336 that are similar to fabric retention members 150 and fabric members 122, 136 as discussed above.

Chair 300 may comprise a front leg 302 and a second front leg 304 connected by a front sled 306, a first back leg 308 and a second back leg 310 connected by a back sled 312, a seat assembly 320, and a back assembly 334. The front legs 302, 304 and the back legs 308, 310 may be pivotally attached to the seat assembly 320. In addition, the portable chair 300 may include a first armrest 384 that is pivotally connected to the first armrest support 377 near the forward end 385 of armrest 384 and also pivotally connected to the back assembly 334 near a rear end 387 of the armrest 384. The first armrest support 377 may be connected to the armrest 384 at the forward connection point, 379 and may be pivotally connected to seat assembly 320 at the second end 381 of the armrest support 377. Similarly, a second armrest 390 may be pivotally connected to a second armrest support 389 near the forward connection point 393 of armrest 390 and that has a first end 391 pivotally connected to seat assembly 320 also pivotally connected to the back assembly 334 near a rear end 395 of the armrest 390. A cam or other locking device may be located at the connection points 379, 393 to secure the chair 300 in the use position. The second armrest support 389 may be connected to the armrest 390 at the first end 397 and may be pivotally connected to seat assembly 320 at the second end 399 of the armrest support 389. Additionally, chair 300 may have a symmetric construction where components on a left side of the chair 300 (i.e. front leg 304) may be mirrored to the components of the right side of the chair 300 (i.e. front leg 302).

As shown in FIG. 26, chair 300 may be easily converted from the use position shown in FIG. 25 to a folded position shown in FIG. 26 for easy transport to another location or storage. Through actuation of the rotational and pivotable interfaces, portable chair 300 may be folded into a portable position as shown in FIG. 25 and unfolded into a seating position as shown in FIG. 25. While in the folded portable position, the chair 300 may be locked and/or sustained in the folded portable position by one or more detents. The one or more detents may provide resistance against the opening of the chair 300 from the folded portable position into the unfolded seating position. While in the unfolded seating position, the one or more detents may additionally provide resistance against the closing of the chair 300 from the unfolded seating position into the folded portable position.

For further example, chair 300 may be configured to open from a folded portable position into an unfolded seating position. To fold the chair 300, the front legs 302, 304 may fold inward towards the back legs 308, 310 and the back legs 308, 310 may fold inward towards the front legs 302, 304. In the folded position, the front legs 302, 304 may be substantially parallel to back legs 308, 310 and seat assembly 320 may be substantially parallel to back assembly 334 as the back assembly folds onto the seat assembly 320.

To adjust chair 300 from an upright position to a reclined position, the cam or other locking device at the connection points 379, 393 may be loosened to allow the back assembly 334 to rotate away from the seat assembly 320. In an upright position, the back assembly 334 may be arranged at an angle to the seat assembly 320 of approximately 99 degrees and in a fully reclined position, the back assembly 334 may form an angle with the seat assembly 320 of approximately 180 degrees or even greater than 180 degrees. The chair 300 may also be adjusted to a partially reclined position such that the back assembly 334 may form any angle between 99 degrees and 180 degrees with the seat assembly 320. When moving to a reclined position the legs 102, 104, 108, 110 may be in an extended position as shown in FIG. 25 or in a retracted or folded position as shown in FIG. 27. When the legs 102, 104, 108, 110 are in the folded position, the chair 300 may rest on the forward rail 326 of the seat frame 324 and the top rail 340 of the back frame 338. The seat side rails 330, 332 may have a portion near the forward rail 326 that is curved downward and also a portion near the rear rail 328 that is curved downward. By curving the seat side rails downward, the forward rail 326 and the rear rail 328 may act as support surfaces for the chair 300 in some arrangements. Similarly, the side back rails 344, 346 may also have a portion that is curved rearward near the top rail 340. This rearward curving portion allows the top rail 340 to act as a support surface in a fully reclined position as shown in FIG. 27.

For the embodiment illustrated in FIGS. 28-34, the features are referred to using similar reference numerals under the "4xx" series of reference numerals, rather than "1xx" as used in the embodiments of FIGS. 1-10. Accordingly, certain features of the chair 400 that were already described above with respect to chair 100 of FIG. 110 may be described in lesser detail, or may not be described at all. FIGS. 28-35 illustrate alternate chair 400. Chair 400 includes a similar leg configuration to chair 100 except chair 400 has a back leg extension 411 between the back legs 408, 410 and a back sled 412, where the back leg extension(s) 411 extends in a different direction than the back legs 408, 410. Optionally, chair 400 may have a single, unitary fabric member 422 that connects to the seat frame 424 and to the back frame 438, where the fabric member 422 extends from the forward rail 426 of the seat frame 424 to the top rail 440 of the back frame 438 of chair 400. In addition, chair 400 may include a different fabric retention method than described above, where the fabric member 422 that is releasably connected to the seat frame 424 and back frame 438 as described in more detail below. Armrests 484, 490 of chair 400 may each include any of the control assemblies 200A-200E described above to control chair 400 moving from an upright to a reclined position.

As shown in FIGS. 28-34, portable chair 400 may comprise a first front leg 402 and a second front leg 404 connected by a front sled 406, a first back leg 408 and a second back leg 410. Each back leg 408, 410 may include a back leg extension 411 that extends outward away from an end of the back legs 408, 410 and connects to the back sled 412. Chair 400 may also include a seat frame 424 and back frame 438. The seat frame 424 may further include front leg attachment portions 480, 482 to pivotally connect and/or fasten the front legs 402, 404, respectively, to the seat frame 424. In addition, portable chair 400 may include a first armrest 484 that is a pivotally connected to the first front leg 402 and the first back leg 408 at a sliding pivot 486 near the front end 485 of the armrest 484 and also pivotally connected to the back assembly 434 at a second connection point 488 near the rear end of the first armrest 484. Similarly, a second armrest 490 may also be pivotally connected to the second front leg 404 and the second back leg 410 at a sliding pivot 492 near the front end 493 of the armrest 490 and also pivotally connected to the back assembly 434 at a second connection point 496 the rear end of the second armrest 490. Additionally, chair 400 may be of a symmetric construction where components on a left side of the chair 400 (i.e. front leg 404) may be mirrored to the components of the right side of the chair 400 (i.e. front leg 402).

Figure 33:
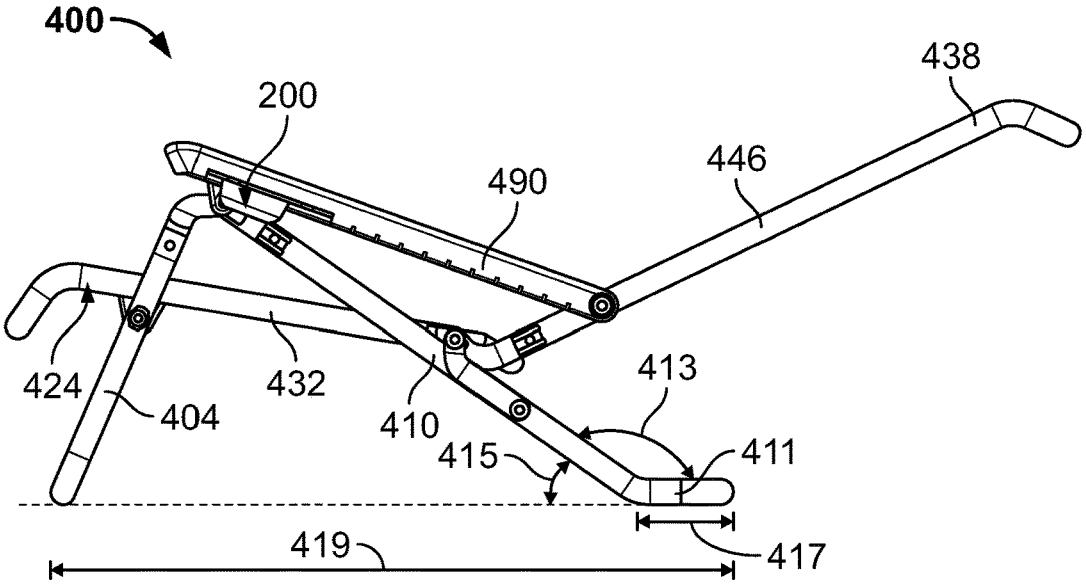
FIG. 33 is a side view of the portable chair of FIG. 28 in an upright position with the fabric member removed for clarity according to aspects disclosed herein.

As discussed above, the back legs 408, 410 may each include a back leg extension 411. The back leg extension 411 may extend rearwardly from a rearmost end of the back legs 408, 410. Each back leg extension 411 may extend substantially parallel to a ground plane when the chair is in an unfolded configuration and may form an obtuse angle 413 with its respective back leg 408, 410. For example, as shown FIG. 31, angle 413 may be a supplementary angle (i.e. the sum of the two angles equals 180 degrees) with angle 415 that is formed between a ground plane and either of the back legs 408, 410. Accordingly, back leg extension 411 may assist in supporting the chair and may provide additional rear support when the chair 400 in in a fully reclined position as shown in FIG. 33. In some examples, the back leg extension 411 may have a length 417 defined as a percentage of the overall length 419 defined as the distance between a forwardmost end of the front sled 406 to a rearmost end of the back sled 412 when the chair 400 is in an unfolded configuration. For instance, the back leg extension 411 may have a length 417 that is approximately 14 percent of the overall length 419 or may be within a range of 8 percent and 20 percent of the overall length 419. The length 417 of the back leg extension 411 may be defined as the distance from the rearmost end of the back sled 412 to a center of the radius or transition between the back leg 410 and back leg extension 411.

The two front legs 402, 404, the two back legs 408, 410, the front sled 406, the back sled 412 along with the rails of the seat frame 424 and back frame 438 may be cylindrical rods, tubes, and/or shafts, or other hollow shape. The front legs 402, 404 and front sled 406 may be formed as a single member. Similarly, the back legs 408, 410, back leg extensions 411, and back sled 412 may be formed as a single member. These components may be made of, for example, aluminum, titanium, stainless steel, scandium, metal alloys, polymers, composites, carbon fiber, and/or wood, such as bamboo. In instances in which aluminum, titanium, stainless steel, scandium, and/or metal alloys are used in the fabrication of the two front legs 402, 404, the two back legs 408, 410, the back leg extensions 411, the front sled 406, the back sled 412 along with the rails of the seat frame 424 and back frame 438, the metallic components may be hydroformed, cast, or formed by another method known to one skilled in the art. Furthermore, the metallic components may be treated through anodizing, plating, painting, powder coating, and/or the application of enamel in order to prevent corrosion induced by environmental conditions such as salt spray. Additionally, the metals and alloys used in the fabrication of the legs 402, 404, 408, 410, the sleds 406, 412, back leg extensions 411, and the rails of the frames 424, 438 may be treated through annealing, case hardening, precipitation strengthening, tempering, normalizing, and/or quenching in order to increase hardness, toughness, and tensile and shear strength.

Chair 400 may have a chair fabric member 422 that releasably connects to both the seat frame 424 and the back frame 438. The fabric member 422 may extend from the forward rail 426 of the seat frame 424 to the top rail 440 of the back frame 438. The fabric member 422 may also extend across from the first side seat rail 430 to the second side seat rail 432 opposite of the first side seat rail 430 of the seat frame 424 and also extend across the first side back rail 444 to the second side back rail 445 opposite the first side back rail 444.

Figure 34:
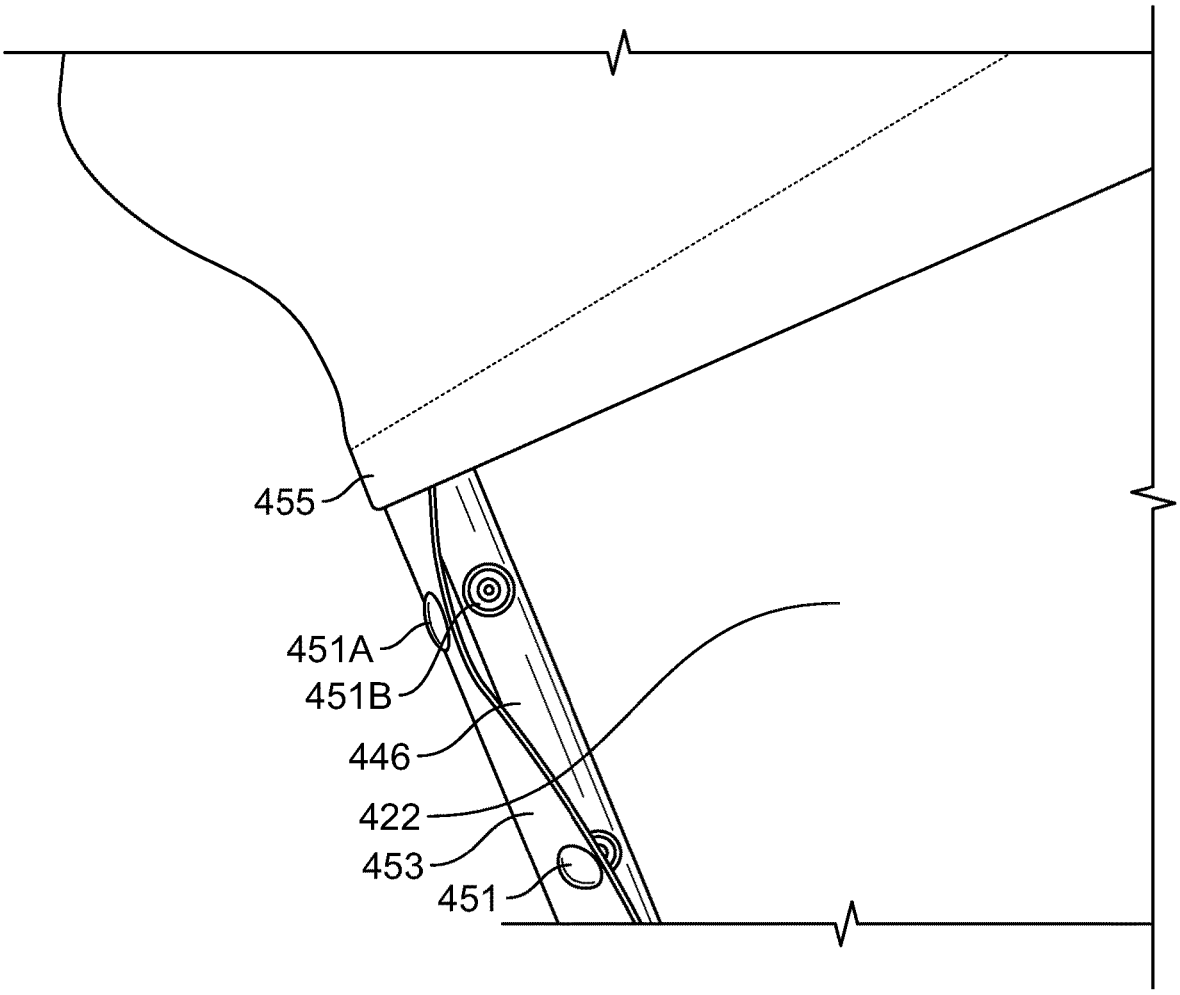
FIG. 34 is a partial rear perspective view of FIG. 28 in an upright position with the fabric member partially attached according to aspects disclosed herein.

The chair fabric member 422 may be secured to the seat frame 424 and the back frame 438 respectively with a plurality of fabric retention members 451 that are located along the seat frame 424 and back frame 438. In some examples, the plurality of fabric retention members 451 may be a plurality of complementary mechanical fasteners, wherein each complementary mechanical fastener 451 may include a first mechanical element 451A and a second mechanical element 451B that connect together to form a releasable connection as shown in FIG. 34. For example, the complementary mechanical fasteners 451 may be snaps, buttons, screws, quarter-turn screws, quarter-turn cams, or other quick release fastener known to one skilled in the art. For example, the fabric retention members 451 may be snaps, as shown in FIG. 34, where a plurality of a female portions of the snaps 451 are permanently attached to the fabric member 422 and these female portion of the snaps 451 releasably connect to a plurality of corresponding male portions of snaps 451 permanently attached to the seat frame 424 and the back frame 438. The releasable connection may allow a user to easily remove the fabric member 422 to clean the fabric separately from the chair 400 or replace a fabric member 422 if it has become damaged. Fabric member 422 may have a plurality of side portions 453 along with forward and top portions 455, where each side portion 453 may be secured to one of the first side seat rail 430, the second side seat rail 432, the first side back rail 444, and the second side back rail 446 using a plurality of mechanical fasteners 451. The side portions 453 of the fabric member 422 may include one of a first mechanical element 451A or a second mechanical element 451B of the fabric retention members 451. Fabric member 422 may include forward and top portions 455 that form a sleeve or pocket that receive the forward rail 426 and top rail 440 respectively. Alternatively, the forward and top portions 455 may releasably connect to the forward rail 426 and top rail 440 similarly to releasable connection of the side portions 453 of fabric member 422 using a plurality of mechanical fasteners 451.

In addition, one of a first mechanical element 451A or a second mechanical element 451B of the fabric retention members 451 may be arranged on an inner surface of the first side seat rail 430, the second side seat rail 432, the first side back rail 444, and the second side back rail 446. In some examples, the first or second mechanical elements 451A, 451B may be evenly spaced apart along the first side seat rail 430, the second side seat rail 432 of the seat frame 424 and also evenly spaced apart along the first side back rail 444, and the second side back rail 446 of the back frame 438. In addition, a first set of fabric retention members 451 positioned on the first side seat rail 430 may face and also be aligned with a second set of fabric retention members 451 positioned on the second side seat rail 432. Similarly, a third set of fabric retention members 451 positioned on the first side back rail 444 may face and be aligned with a fourth set of fabric retention members 451 positioned on the second side back rail 446.

While various embodiments have been described, it will be apparent to those of ordinary skill in the art that many more embodiments and implementations are possible that are within the scope of the claims. The various dimensions described above are merely exemplary and may be changed as necessary. Accordingly, it will be apparent to those of ordinary skill in the art that many more embodiments and implementations are possible that are within the scope of the claims. Therefore, the embodiments described are only provided to aid in understanding the claims and do not limit the scope of the claims.

We claim:

1. A portable chair comprising:

a first front leg and a second front leg connected by a front sled;

a first back leg and a second back leg connected by a back sled;

a seat frame including a forward rail, a rear rail opposite the forward rail, a first seat side rail extending between the forward rail and the rear rail, and a second seat side rail extending between the forward rail and the rear rail opposite the first seat side rail, a back frame including a top rail, a first back side rail extending downward from the top rail, and a second back side rail extending downward from the top rail opposite the first back side rail, a fabric member releasably connected to the seat frame and the back frame, wherein the fabric member extends from the forward rail to the top rail; and an armrest comprising an armrest body that is pivotally connected to the back frame at a rear end portion, and a control assembly connected to the armrest body, wherein the control assembly includes a sliding pivot that is pivotally attached to the first front leg and the first back leg and is also slidably engaged with the armrest, and wherein the armrest has a rear end pivotally connected to the back frame, wherein a rearward movement of the sliding pivot causes the portable chair to move from an upright position to a reclined position, wherein the sliding pivot comprises a first set of engaging teeth that engage with a second set of engaging teeth to secure the sliding pivot in a fixed location relative to the armrest body, and wherein the portable chair has an unfolded position and a folded position.

2. The portable chair of claim 1, wherein the control assembly further includes a side paddle that is pivotally attached to the armrest body such that when the side paddle is rotated inward, the second set of engaging teeth disengage from the first set of engaging teeth to allow the sliding pivot to move relative to the armrest body.

3. The portable chair of claim 2, wherein the side paddle comprises an actuation portion that receives contact from a user, a receiver that defines a rotational axis and receives a pin, and an engaging portion, wherein the actuation portion and engaging portion are positioned substantially perpendicular to each other.

4. The portable chair of claim 3, wherein the second set of engaging teeth are attached to the engaging portion of the side paddle.

5. The portable chair of claim 2, wherein the side paddle is positioned on an outboard side of the armrest.

6. The portable chair of claim 1, wherein the sliding pivot slides along a guide rail positioned along a bottom of the armrest body.

7. The portable chair of claim 6, wherein the guide rail is integrally formed with the armrest body.

8. A portable chair comprising:

a first front leg and a second front leg connected by a front sled;

a first back leg and a second back leg connected by a back sled, wherein a first back leg extension is positioned between the first back leg and the back sled and a second back leg extension is positioned between the second back leg and the back sled, wherein the first back leg extension extends in a different direction than the first back leg;

a seat frame including a forward rail, a rear rail opposite the forward rail, a first seat side rail extending between the forward rail and the rear rail, and a second seat side rail extending between the forward rail and the rear rail opposite the first seat side rail, a back frame including a top rail, a first back side rail extending downward from the top rail, and a second back side rail extending downward from the top rail opposite the first back side rail, a fabric member releasably connected to the seat frame and the back frame, wherein the fabric member extends from the forward rail to the top rail; and an armrest comprising an armrest body that is pivotally connected to the back frame at a rear end portion, and a control assembly connected to the armrest body, wherein the control assembly includes a sliding pivot that is pivotally attached to the first front leg and the first back leg and is also slidably engaged with the armrest, and wherein the armrest has a rear end pivotally connected to the back frame, wherein a rearward movement of the sliding pivot causes the portable chair to move from an upright position to a reclined position, wherein the sliding pivot comprises a first set of engaging teeth that engage with a second set of engaging teeth to secure the sliding pivot in a fixed location relative to the armrest body, and wherein the portable chair has an unfolded position and a folded position.

9. The portable chair of claim 8, wherein the first back leg extension forms an obtuse angle with the first back leg.

10. A portable chair comprising:

a first front leg and a second front leg connected by a front sled;

a first back leg and a second back leg connected by a back sled;

a seat frame including a forward rail, a rear rail opposite the forward rail, a first seat side rail extending between the forward rail and the rear rail, and a second seat side rail extending between the forward rail and the rear rail opposite the first seat side rail, a back frame including a top rail, a first back side rail extending downward from the top rail, and a second back side rail extending downward from the top rail opposite the first back side rail, a fabric member releasably connected to the seat frame and the back frame, wherein the fabric member extends from the forward rail to the top rail, wherein the fabric member includes a plurality of side portions, wherein each side portion of the plurality of side portions is secured to one of the first side seat rail, the second side seat rail, the first back side rail, and the second back side rail using a plurality of fabric retention members, and an armrest comprising an armrest body that is pivotally connected to the back frame at a rear end portion, and a control assembly connected to the armrest body, wherein the control assembly includes a sliding pivot that is pivotally attached to the first front leg and the first back leg and is also slidably engaged with the armrest, and wherein the armrest has a rear end pivotally connected to the back frame, wherein a rearward movement of the sliding pivot causes the portable chair to move from an upright position to a reclined position, and wherein the portable chair has an unfolded position and a folded position.

11. The portable chair of claim 10, wherein the plurality of fabric retention members comprise a plurality of complementary mechanical fasteners, wherein each complementary mechanical fastener includes a first mechanical element and a second mechanical element that connect together to form a releasable connection.

12. The portable chair of claim 11, wherein the first side seat rail includes a first set of first mechanical elements and the second side seat rail includes a second set of first mechanical elements that face each other.

13. A portable chair comprising:

a first front leg and a second front leg connected by a front sled;

a first back leg and a second back leg connected by a back sled;

a seat frame including a forward rail, a rear rail opposite the forward rail, a first seat side rail extending between the forward rail and the rear rail, and a second seat side rail extending between the forward rail and the rear rail opposite the first seat side rail, a back frame including a top rail, a first back side rail extending downward from the top rail, and a second back side rail extending downward from the top rail opposite the first back side rail, a fabric member releasably connected to the seat frame and the back frame, wherein the fabric member extends continuously from the forward rail to the top rail, wherein the fabric member is connected to the seat frame and to the back frame using a plurality of complementary mechanical fasteners; and an armrest comprising an armrest body that is pivotally connected to the back frame at a rear end portion, and a control assembly connected to the armrest body, wherein the control assembly includes:

a sliding pivot pivotally attached to the first front leg and the first back leg and also slidably engaged with the armrest, wherein the sliding pivot includes a first set of engaging teeth;

a side paddle pivotally attached to the armrest body, wherein the side paddle includes a second set of engaging teeth that engage with the first set of engaging teeth to secure the sliding pivot in a fixed location relative to the armrest body, and at least one resilient member positioned between the side paddle and the armrest body, wherein the at least one resilient member exerts a force on the side paddle to keep the second set of engaging teeth in contact with the first set of engaging teeth; and wherein when the side paddle is rotated inward, the second set of engaging teeth disengage from the first set of engaging teeth to allow the sliding pivot to move relative to the armrest body causing the portable chair to move from an upright position to a reclined position.

14. The portable chair of claim 13, wherein at least one tooth of the second set of engaging teeth has an outboard chamfered edge.

15. A portable chair comprising:

a first front leg and a second front leg connected by a front sled;

a first back leg and a second back leg connected by a back sled;

a seat frame pivotally engaged with the first front leg and the second front leg, wherein the seat frame includes a forward rail, a rear rail opposite the forward rail, a first seat side rail extending between the forward rail and the rear rail, and a second seat side rail extending between the forward rail and the rear rail opposite the first seat side rail;

a fabric retention member attached to the seat frame, wherein the fabric retention member includes a rounded exterior surface, a first interior cavity, and a second interior cavity, wherein the first interior cavity engages a portion of the seat frame; and a fabric member having a first end secured to the seat frame by the fabric retention member, wherein the first end of the fabric member is secured in the second interior cavity of the fabric retention member and the fabric member wraps around a portion of the rounded exterior surface of the fabric retention member before extending across an unsupported region of the seat frame.

16. The portable chair of claim 15, wherein the first end of the fabric member has a loop that receives a rod to secure the fabric member in the fabric retention member.

17. The portable chair of claim 15, wherein the first interior cavity has a partial cylindrical shape and the second interior cavity has a partial cylindrical shape, and wherein the first interior cavity has a larger radius than the second interior cavity.

18. The portable chair of claim 15, wherein the first interior cavity includes a first opening that extends an overall length of the fabric retention member, and the second interior cavity includes a second opening that extends the overall length of the fabric retention member, and wherein the first end of the fabric member has a loop that receives a rod to secure the fabric member in the fabric retention member, and wherein a width across the second opening is less than a diameter of the rod.

19. The portable chair of claim 18, wherein an outboard edge adjacent the second opening has a substantially rounded shape, wherein a radius of the outboard edge is at least 10 times a thickness of the fabric member.

* * * * *